US011434634B2

(12) United States Patent
Fedor et al.

(10) Patent No.: US 11,434,634 B2
(45) Date of Patent: Sep. 6, 2022

(54) METHOD AND APPARATUS FOR SUPPORTING AND MOVING A LONG-SPAN STRUCTURE ON A RAIL SYSTEM

(71) Applicants: Morgan Engineering Systems, Inc., Alliance, OH (US); Hardesty & Hanover, LLC, Wilmington, DE (US)

(72) Inventors: Mark L. Fedor, Hartville, OH (US); Kenneth D. Maurer, Louisville, OH (US); Craig J. Johnson, Montclair, NJ (US); Barry Ho-yeen Keung, New York, NY (US); John B. Hamill, Jenkintown, PA (US)

(73) Assignees: MORGAN ENGINEERING SYSTEMS, INC., Alliance, OH (US); HARDESTY & HANOVER, LLC, Wilmington, DE (US)

( * ) Notice: Subject to any disclaimer, the term of this patent is extended or adjusted under 35 U.S.C. 154(b) by 355 days.

(21) Appl. No.: 16/708,998

(22) Filed: Dec. 10, 2019

(65) Prior Publication Data

US 2020/0181900 A1 Jun. 11, 2020

Related U.S. Application Data

(60) Provisional application No. 62/778,053, filed on Dec. 11, 2018.

(51) Int. Cl.
*E04B 7/16* (2006.01)
*E04B 1/343* (2006.01)
(Continued)

(52) U.S. Cl.
CPC ..... *E04B 1/343* (2013.01); *E04B 1/342* (2013.01); *E04B 7/166* (2013.01); *E04H 3/14* (2013.01)

(58) Field of Classification Search
CPC ..... E04B 1/343; E04B 1/342; E04B 7/166; E04H 3/14
See application file for complete search history.

(56) References Cited

U.S. PATENT DOCUMENTS 3,316,682 A * 5/1967 Natalis ..... E04B 1/342 52/236.1
5,257,485 A * 11/1993 Kawaguchi ..... E04B 7/163 52/6
(Continued)

*Primary Examiner* — Paola Agudelo
(74) *Attorney, Agent, or Firm* — Sand, Sebolt & Wernow Co., LPA

(57) ABSTRACT

A long-span structure engaged with a plurality of first and second transportation devices for moving the long span structure. The transportation devices travel along parallel, longitudinally-oriented first and second tracks; moving the structure between a first position and a second position. A first region of the structure is fixed to each first transportation device. A second region of the structure is secured to each second transportation device via a bearing assembly. The first and second regions of the structure are laterally spaced apart. When the long-span structure thermally expands or contracts, a slider plate of each bearing assembly moves laterally relative to the rest of the bearing assembly. Growth of the structure in a predictable direction is forced by keeping the first region thereof fixed against lateral movement with the first transportation devices and allowing movement of the second region thereof via the bearing assemblies on the second transportation devices.

12 Claims, 18 Drawing Sheets

(51) Int. Cl.
*E04H 3/14* (2006.01)
*E04B 1/342* (2006.01)

(56) References Cited

U.S. PATENT DOCUMENTS

| | | | | | |
|---|---|---|---|---|---|
| 5,682,711 | A * | 11/1997 | Warczak | E04H 3/14 | 52/6 |
| 5,896,708 | A * | 4/1999 | Doi | E04B 7/166 | 52/66 |
| 5,904,003 | A * | 5/1999 | Stephen | E04B 7/166 | 52/6 |
| 6,367,206 | B1 | 4/2002 | Silberman et al. | | |
| 6,415,556 | B1 * | 7/2002 | Silberman | E04B 7/166 | 52/6 |
| 6,698,141 | B2 * | 3/2004 | Silberman | E01C 13/083 | 472/42 |
| 6,789,360 | B2 * | 9/2004 | Silberman | E04B 7/166 | 52/6 |
| 7,594,360 | B2 * | 9/2009 | Silberman | E04B 7/166 | 52/6 |
| 8,186,107 | B2 * | 5/2012 | Silberman | E04B 7/166 | 52/6 |
| 2003/0019166 | A1 * | 1/2003 | Sprung | E04H 6/44 | 52/64 |
| 2018/0058500 | A1 * | 3/2018 | MacBain | F16C 29/02 | |
| 2020/0087912 | A1 * | 3/2020 | Konings | E04H 3/14 | |

* cited by examiner

METHOD AND APPARATUS FOR SUPPORTING AND MOVING A LONG-SPAN STRUCTURE ON A RAIL SYSTEM

CROSS-REFERENCE TO RELATED APPLICATIONS

This application claims the benefit of U.S. Provisional Patent Application Ser. No. 62/778,053, filed Dec. 11, 2018, the entire specification of which is incorporated herein by reference.

TECHNICAL FIELD

This disclosure is generally directed to a method and apparatus for supporting and moving a long-span structure. More particularly, this disclosure is directed to a method and apparatus for supporting and moving a long-span structure on one or more rails of a rail system. Specifically, this disclosure is directed to a bogie that is used to support the long-span structure and move the same on the rails of a rail system. A slide bearing assembly is utilized on the bogie to accommodate thermal expansion and contraction in the long-span structure.

BACKGROUND

Background Information

A number of large stadiums, such as football stadiums, are provided with some type of roof or covering that protects the fans from the elements. In many instances, the roof is a permanent structure that extends over a portion of the stands, leaving the rest of the stands and the playing surface exposed to the elements.

In other instances, the roof or covering is comprised of a fixed roof structure and a movable roof structure. The fixed roof structure extends permanently over at least a portion of the stands. The movable roof structure may be selectively moved relative to the fixed roof structure between a first position and a second position. In the first position, the movable roof structure moves across an opening in the roof and covers part of the stands and/or the playing surface. In the second position, the movable roof structure does not close off the opening and cover part of the stands and/or the playing surface. If the weather is pleasant, the movable roof structure may be moved into the second position so that the playing surface is open to the environment. If, on the other hand, the weather is inclement, the movable roof structure may be moved into the first position and the playing surface will then be covered and protected from the weather outside the stadium.

These movable roof structures are typically long-span structures fabricated from a plurality of trusses and roof panels. They tend to be large and heavy and may need to be moved over quite large distances in a relatively short time period. The movable roof structures also tend to be somewhat vulnerable to weather. For example, wind may tend to lift and twist the roof panels and trusses. Additionally, snow and rain may accumulate on movable roof structures and increase the overall weight the structure has to bear. This additional weight can damage the roof panels and/or trusses, particularly if the movable roof structure is in the second position, i.e., the deployed position.

In the past, bogies have been used to support and move movable roof structures on rails of a rail system. Typically, the roof trusses are bolted or welded to the bogies. Multiple bogies are used to engage and support the roof panels and trusses and are arranged so that the load is generally evenly distributed over the multiple bogies. If required, some type of uplift prevention system may also be provided at the bogie/rail interface to help prevent the roof structure from being lifted off the stadium by wind. The uplift prevention system may be in the form an uplift clip system that is integral with the bogies.

If the weather is quite hot, the roof panels and/or the trusses, which are typically fabricated from metal, tend to undergo thermal expansion. As the panels or trusses expand, the movable roof structure may tend to grow in length. This growth can cause the panels and/or trusses to become slightly warped and thereby cause the load carried by the bogies to shift. For example, the load on individual bogies may increase or decrease to the point that welds or bolts securing the trusses to the bogies fail, or the supporting structure beneath the bogies comes under undue strain. The same problem may occur if the movable roof structure experiences thermal contraction (i.e., shrinkage) because of unduly cold conditions. In order to address this issue previously designed movable long-span systems have incorporated some type of release mechanism to try and prevent damage from the effects of thermal movements.

SUMMARY

The apparatus, systems, and methods disclosed herein address some of the issues experienced with prior art movable roof structures. In particular, the apparatus, system, and method disclosed herein provide an improved way of arranging bogies on a rail system to support a movable long-span structure. In particular, the improved apparatus, system, and method provides a way to address issues due to thermal expansion of the long-span structure. The improvement comprises the use of one or more bearings, particularly commercially-available bearings, at the bogie/long-span structure interface. In particular, the present disclosure presents a more efficient way of supporting a movable long-span structure using standard bridge bearings or building style structural bearings.

In particular, the present disclosure is directed to a bogie for supporting a movable long-span structure, such as a movable roof structure for a stadium, which tends to better accommodate thermal expansion and contraction. The disclosure is further directed to a combination a movable long-span structure supported by two different types of bogies where one type of bogie accommodates thermally-induced changes in the roof, and to a method of forcing thermal growth of a movable long-span structure in a desired direction. It will be understood that while the disclosure describes a long-span structure used in the context of a movable roof for a stadium, the disclosure is equally applicable to any long-span structure that is movable along rails of a rail system.

A long-span structure engaged with a plurality of first and second transportation devices for moving the long span structure is disclosed herein. The transportation devices travel along parallel, longitudinally-oriented first and second tracks; moving the structure between a first position and a second position. A first region of the structure is fixed to each first transportation device. A second region of the structure is secured to each second transportation device via a bearing assembly. The first and second regions of the structure are laterally spaced apart. When the long-span structure thermally expands or contracts, a slider plate of each bearing assembly moves laterally relative to the rest of the bearing assembly. Growth of the structure in a predictable direction is forced by keeping the first region thereof fixed against lateral movement with the first transportation devices and allowing movement of the second region thereof via the bearing assemblies on the second transportation devices. This arrangement helps to ensure that the load carried by the first and second bogies is distributed properly.

In one aspect, the present disclosure may provide a movable long-span structure comprising at least one long-span assembly; a plurality of first transport devices fixedly engaged with a first region of the at least one long-span assembly; a plurality of second transport devices engaged with a second region of the at least one long-span assembly, wherein the second region is spaced a distance from the first region; and a plurality of slide bearing assemblies, wherein each of the plurality of slide bearing assemblies secures one of the plurality of second transport devices to the at least one long-span assembly and enables movement of the second region of the at least one long-span assembly relative to the first region thereof.

In one aspect, the present disclosure may provide a system for moving a long-span structure relative to a base member; said system comprising at least one first bogie engaged proximate a first end of a long-span structure and movable along a first track; and at least one second bogie engaged proximate a second end of the long-span structure and movable along a second track; wherein the first end and the second end of the long-span structure are spaced laterally apart from each other; and the first track and second track extend longitudinally; and wherein each of the at least one second bogie includes a slide bearing assembly interposed between a body of the at least one second bogie and the long-span structure.

In one aspect, the present disclosure may provide a bogie for supporting a long-span structure, said bogie comprising a body having a top, a bottom, a first end, a second end, and a first side and a second side extending between the first end and the second end; wherein the body has a longitudinal axis extending between the first end and the second end; a drive system provided on the body, said drive system being actuatable to move the body in one of a first longitudinal direction and a second longitudinal direction along a pathway; and a bearing assembly provided on the body; said bearing assembly being adapted to be engaged with a long-span structure.

It will be understood that the apparatus and method disclosed herein may be used in a variety of settings including on a movable roof structure for an athletic stadium that includes rails mounted on girders. The apparatus and method may also work on a roof mechanism that includes an external drive system as opposed to a traction wheel drive system. One suitable type of external drive system that the present apparatus may function with is a rope drive system but other external drive systems are also possible.

In another aspect, the present disclosure may provide a system for moving a structure relative to a base member; said system comprising at least one first bogie adapted to be engaged proximate a first end of a structure and to be movable along a first track; and at least one second bogie adapted to be engaged proximate a second end of the structure and to be movable along a second track; wherein the first end and the second end of the structure are spaced laterally apart from each other; and the first track and second track extend longitudinally in the base member; and wherein the at least one second bogie includes a slide bearing adapted to be interposed between a body of the at least one second bogie and the structure.

In another aspect, the present disclosure may provide a movable long-span for an athletic stadium comprising a long-span structure including a roof panel engaged with a truss assembly; a plurality of first bogies fixedly engaged with a first region of the truss assembly; a plurality of second bogies engaged with a second region of the truss assembly, wherein the second region is spaced laterally from the first region; and a plurality of slide bearing assemblies, wherein each of the plurality of slide bearing assemblies secures one of the plurality of second bogies to the truss assembly and enables lateral movement of the second region of the truss assembly relative to the first region thereof.

In another aspect, the present disclosure may provide a method of moving a long-span structure comprising mounting a first rail and a second rail to a support structure such that the first rail and second rail are parallel and spaced apart; engaging a plurality of first transport devices on the first rail; fixedly securing each of the plurality of first transport devices to a first region of a long-span structure; engaging a plurality of second transport devices on the second rail; securing a bearing assembly provided on each of the plurality of second transport devices to a second region of the long-span structure; actuating the plurality of first transport devices and the plurality of second transport devices; and moving the long span-structure along the first rail and the second rail from a first position to a second position remote from the first position.

The method further comprises thermally expanding or thermally contracting the movable long-span-structure and sliding a slider plate of the bearing assembly of each of the plurality of second transport devices laterally with respect to the second rail. The sliding further includes sliding the slider plate in a lateral first direction when the long-span structure thermally expands and sliding the slider plate in a lateral second direction when the long-span structure contracts. The method further comprises substantially preventing lateral movement of the first region of the long-span structure with the plurality of first transport devices. The method further comprises permitting lateral movement of the second region of the long-span structure with the bearing assembly of each of the plurality of second transport devices. The method further comprises forcing growth of the long-span structure in a predetermined direction. The forcing of growth in a first predetermined direction occurs when the long-span structure is heated. The forcing of growth in a second predetermined direction occurs when the long-span structure is cooled.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
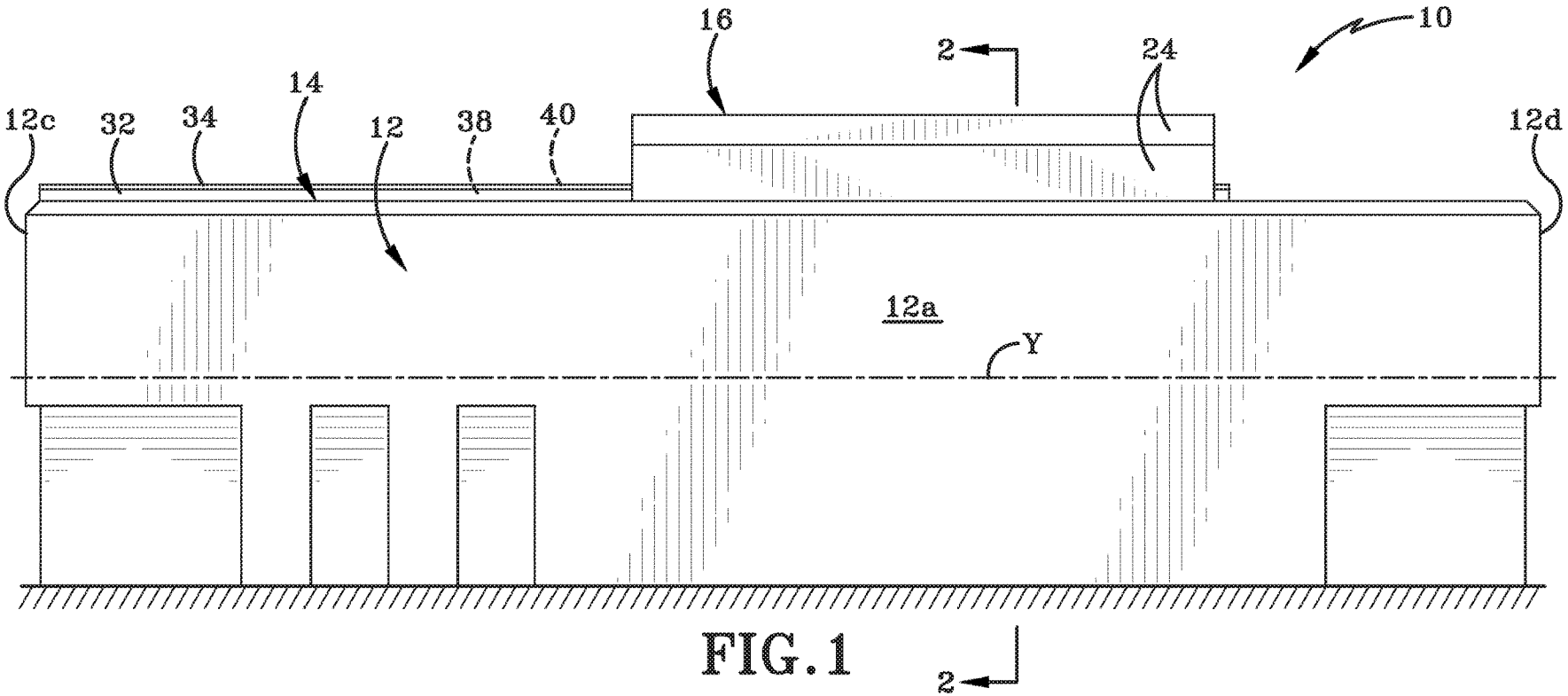
FIG. 1 is a diagrammatic side elevation view of an athletic stadium showing a stadium wall as well as a portion of a fixed roof structure and a movable long-span structure.
Figure 2:
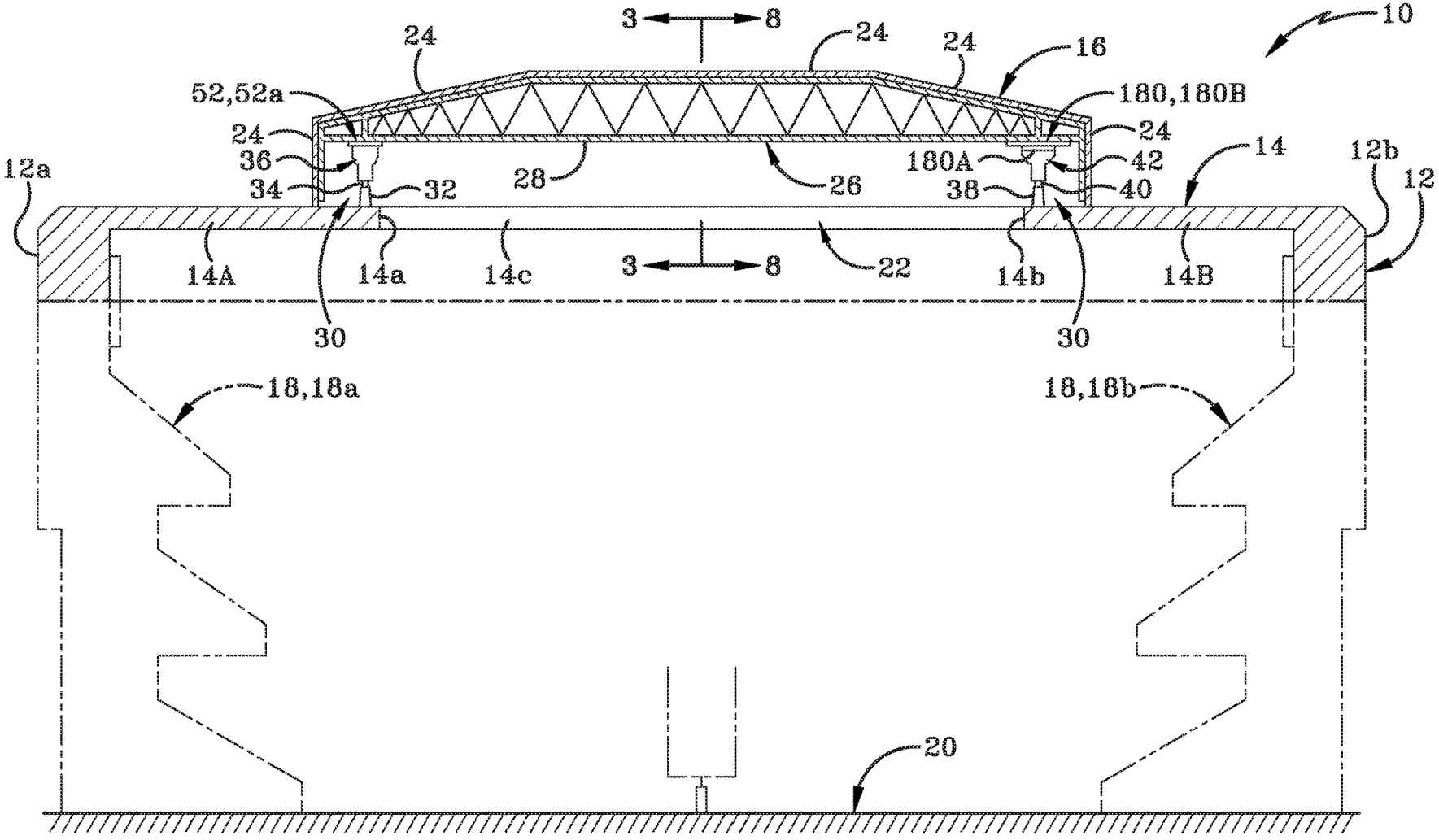
FIG. 2 is an end elevation view of the athletic stadium taken along line 2-2 of FIG. 1, showing a support assembly upon which the movable long-span structure is mounted in accordance with an aspect of the present disclosure.

Referring to FIGS. 1 and 2, there is shown a diagrammatic representation of an athletic stadium 10. Stadium 10 is illustrated as including a perimeter wall 12, a roof comprised of a fixed roof structure 14 and a movable roof structure 16, stadium seating 18, and a playing surface 20. Wall 12 is depicted as being generally rectangular in shape but it will be understood that the perimeter wall of stadium 10 may be configured in shapes other than a rectangle. Wall 12, as depicted, has a first end 12*a*, a second end 12*b*, a first side 12*c*, and a second side 12*d*. First and second sides 12*c*, 12*d* define a longitudinal direction "Y" or longitudinal axis "Y" therebetween. First and second ends 12*a*, 12*b* define a lateral direction therebetween, where the lateral direction is oriented at right angles to the longitudinal axis "Y". Fixed roof structure 14 is depicted as extending inwardly from a top region of perimeter wall 12. While fixed roof structure 14 has been illustrated herein as being a generally horizontal structure, it will be understood that the fixed roof structure 14 may be angle slightly upwardly or downwardly, be generally arcuate, or generally domed in configuration. The specific configuration of the wall 12 and the fixed roof structure 14 may take any of a number of different shapes and types.

Figure 12:
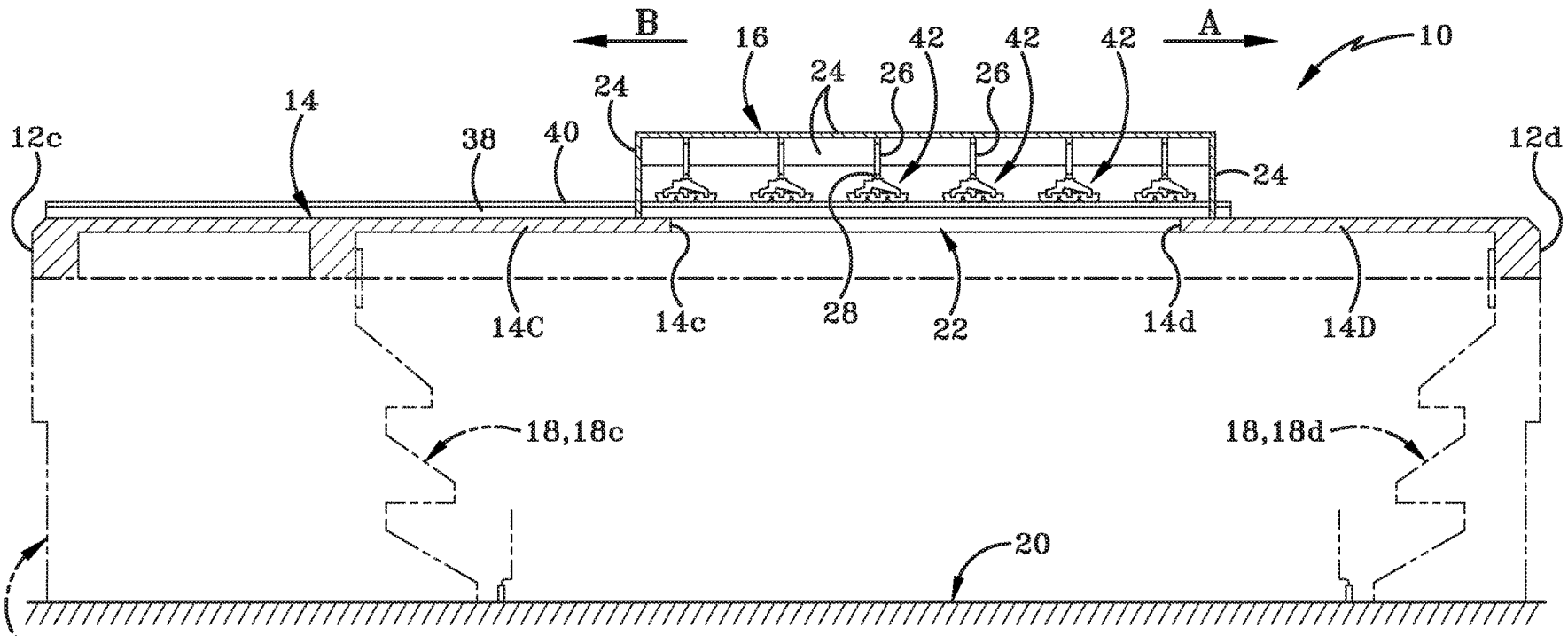
FIG. 12 is a longitudinal cross-section through the athletic stadium showing a plurality of second bogies supporting the movable long-span structure, where the movable long-span structure is in a first position closing off an opening in the roof of the stadium.
Figure 13:
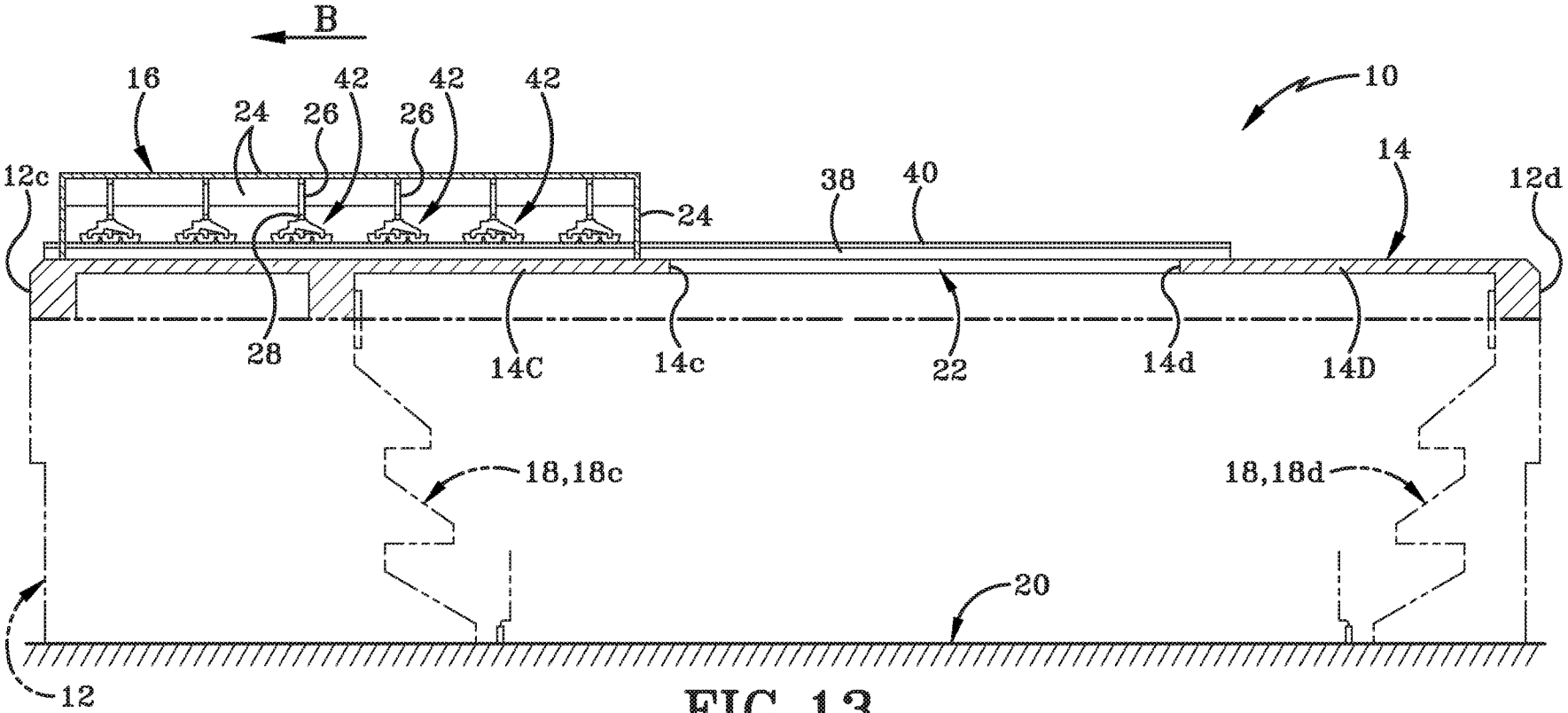
FIG. 13 is a longitudinal cross-section through the athletic stadium showing the plurality of second bogies supporting the movable long-span structure, where the movable long-span structure is in a second position where the movable long-span structure no longer closes off the opening in the roof of the stadium.

Fixed roof structure 14 may include a one or more fixed regions. By way of example only, fixed roof structure 14, as shown in FIGS. 2, 12, and 13 includes a first fixed region 14A and an opposed second fixed region 14B. First fixed region 14A extends inwardly from first end 12*a* of wall 12 and over a first seating region 18A. First fixed region 14A terminates at a first side 14*a* that may be vertically positioned over a section of the first seating region 18A or over a portion of the playing surface 20. Second fixed region 14B extends inwardly from second end 12*b* of wall 12 and over a second seating region 18B. Second fixed region 14B terminates at a second side 14*b* that may be vertically positioned over second seating region 18B or over another portion of playing surface 20.

As is best seen in FIGS. 12 and 13, a third fixed region 14C of fixed roof structure 14 extends inwardly from first side 12*c* of wall 12 and over a third section of stadium seating 18*c*, terminating at a first end 14*c*. First end 14*c* may be located over the associated section 18*c* of stadium seating or over a portion of the playing surface 20. A fourth fixed region 14D of fixed roof structure 14 extends inwardly from second side 12*d* of wall 12 and over an opposed fourth section 18*d* of the stadium seating, terminating at a second end 14*d*. Second end 14*d* may be located above the associated stadium seating 18*d* or over yet another portion of playing surface 20. An opening 22 in the fixed roof structure 14 is bounded and defined by first side 14*a*, second side 14*b*, first end 14*c*, and second end 14*d* of fixed roof structure 14.

It will be understood that fixed roof structure 14 may be mounted to wall 12 and to a variety of other supports and columns that may extend upwardly and outwardly from wall 12 and/or upwardly and outwardly from the floor of stadium 10. The specific configuration of fixed roof structure 14 and the manner in which fixed roof structure 14 is supported are not discussed or disclosed herein as a wide variety of fixed roof structures are well known in the art. The configuration of movable roof structure 16 will be understood to be complementary to the design of fixed roof structure 14 and of the overall stadium 10. The specific description of these structures in this document are by way of example only and should not be considered to unnecessarily limit the scope of the disclosure.

Movable roof structure 16 is selectively movable relative to fixed roof structure 14 between a first position where movable roof structure 16 extends across and closes off opening 22 (FIGS. 1, 2 and 12), and a second position where movable roof structure 16 does not close off opening 22

(FIG. 13). For example, the movable roof structure 16 may be moved between the third fixed region 14C in a first direction "A" towards the fourth fixed region 14D to close off opening 22. Movable roof structure 16 may be moved in a second direction "B" away from fourth fixed region 14D and towards third fixed region 14C to uncover opening 22. Movable roof structure 16 may also, in some examples, be positionable at an intermediate position between the first and second positions so that only a part of the opening 22 is covered. In the first position, movable roof structure 16 is positioned in such a way that the stadium seating 18 and playing surface 20 are effectively indoors. In the second position, movable roof structure 16 is positioned in such a way that the playing surface 20 and possibly some of the stadium seating 18 are effectively outdoors. Movable roof structure 16 is moved to the first position when inclement weather is expected for an athletic event. It will be understood that in some examples, the movable roof structure 16 may be comprised of more than one movable region.

As discussed earlier herein, movable roof structure 16 is a long-span assembly or long-span structure that is comprised of one or more roof panels 24 which are engaged with one or more long-span trusses 26. Each panel 24 is fabricated from one or more sheet materials or membranes that are secured to the one or more trusses 26. Suitable materials for the panels 24 may include flexible composite materials, metal, fabrics, and the like. The trusses 26 are arranged and secured together to give the movable roof structure 16 the desired shape. The plurality of trusses 26 includes at least a lowermost beam, such as the I-beam 28, illustrated in FIGS. 2 and 3.

In accordance with an aspect of the present disclosure, a support assembly is provided for operatively engaging movable roof structure 16 to one or both of fixed roof structure 14 and wall 12. The support assembly is generally indicated by reference number 30 (FIG. 2). Support assembly 30 may comprise a rail system and a plurality of bogies that are operatively engaged with the movable roof structure 16 and with the rail system. The rail system includes at least a first girder 32 and a first rail 34. The rail system may further include a second girder 38 and a second rail 40.

As depicted in the attached figures, first and second girders 32, 38 extend between first side 12*c* and second side 12*d* of stadium 10, are oriented substantially parallel to each other, and are spaced laterally a distance apart from each other. First and second girders 32, 38 are illustrated as being oriented substantially parallel to the longitudinal axis "Y" of stadium 10. First rail 34 is mounted generally centrally along a midline of an upper surface of first girder 32. Consequently, first rail 34 is oriented generally parallel to longitudinal axis "Y". Similarly, second rail 40 is mounted generally centrally along a midline of an upper surface of second girder 38 and is therefore oriented generally parallel to longitudinal axis "Y".

The first and second rails 34, 40 are thus parallel to each other and laterally spaced from each other. The longitudinal axis "Y" may also be referred to as the direction of the rail or the direction of travel of the movable roof structure 16. A transverse axis (i.e., lateral axis) oriented at ninety degrees to longitudinal axis "Y" may be referred to as perpendicular to the rail or perpendicular to the direction of travel of the roof panel. These directions typically coincide with the long dimension of the stadium 10 and short dimension of the stadium 10 in plan, respectively.

First and second girders 32, 38 are supported at a desired height from the ground. As illustrated in the attached figures, first and second girders 32, 38 are mounted on an exterior surface of fixed roof structure 14. It will be understood, however, that any suitable placement and method of mounting first and second girders 32, 38 is contemplated to fall within the scope of the present disclosure. Each girder 32, 38 may be substantially straight along its length. If the design of the stadium requires it, each girder 32, 38 may be curved along its length or include straight sections and curved sections.

It will be understood that in another examples, first and second girders 32, 38 may be oriented substantially parallel to a lateral axis or to an axis oriented differently to either of the longitudinal axis "Y" or lateral axis of the stadium. This orientation is not typically utilized for the direction of travel of the movable roof structure but is possible. In other instances, the stadium may be symmetrical and the movement of the movable roof structure is along an axis chosen by the architect. The axis selected by the architect may often be selected to optimize how shadows are cast on the playing surface by the sun or to match the size and shape of the playing surface and limits of the spectator seating.

The plurality of bogies are engaged with the first and second rails 34, 40. The plurality of bogies include a plurality of first bogies 36 (FIG. 3) that are operably engaged with the first rail 34 and a plurality of second bogies 42 (FIG. 8) that are operably engaged with the second rail 40.

The first bogies 36 that are operatively engaged with the first rail 34 are all substantially identical in structure and function to each other and all are fixedly secured to the trusses 26 and/or panels 24 of movable roof structure 16. As illustrated in the attached figures, the first bogies 36 are fixedly secured to the lowermost I-beam 28 of movable roof structure 16. In particular, each first bogie is bolted or welded or otherwise secured immovably to I-beam 28. First bogies 36 are therefore of a type that will be referred to hereinafter as a "fixed" bogie".

The second bogies 42 that are operatively engaged with the second rail 40 are all substantially identical in structure and function to each other. The second bogies 42 differ from the first bogies 36 in both structure and function. Second bogies 42 are not fixedly secured to the trusses 26 or panels 24 of the movable roof structure 16. In particular, second bogies 42 are floatingly or slidingly engaged with the lowermost I-beam 28 of the movable roof structure 16. Each second bogie 42 will therefore be referred to hereinafter as a "float bogie" or a "slide bogie". The first and second bogies 36, 42 will be further described hereafter. Two or more first bogies 36 and two or more second bogies 42 are utilized to operatively engage movable roof structure 16 to the rail system.

In order to operatively engage and adequately support movable roof structure 16 with the rail system, i.e., with first and second rails 34, 40 and first and second girders 32, 38, about ten first bogies 36 and about ten second bogies 42 may be utilized. The same number of first and second bogies 36, 42 will typically be used to engage and support a movable roof structure 16 with the rail system. Each of the first and second bogies 36, 42 is operatively secured to a section of the trusses 26, for example, to the I-beam 28, or is secured to the panels 24. Each of the first and second bogies 36, 42 is engaged with the associated first or second rail 34, 40 and the bogies are spaced at substantially uniform intervals from each other along the associated rail.

It will be understood that the size and weight of each of the first bogies 36 and second bogies 42 is selected based on the specific engineering application. By way of example only, each of the first bogies 36 and each the second bogies 42 may weigh around twenty-five tons and may be about twenty-four feet long and about ten feet high. The maximum width of certain regions of each of the first bogies 36 and second bogies 42 may also differ and will be discussed later herein.

FIGS. 3 to 7 show a single first bogie 36 that may be engaged with first rail 34 and thereby with first girder 32. In other words, FIGS. 3 to 6 show a fixed bogie 36 in greater detail. FIGS. 8 to 11 show a single second bogie 42 that may be engaged with second rail 40 and thereby with second girder 38. In other words, FIGS. 8 to 11 show a float bogie or slide bogie in greater detail.

Referring to FIGS. 3 to 7, first bogie 36 comprises a body that generally has a top 36*a*, a bottom 36*b*, a first side 36*c*, a second side 36*d*, a first end 36*e*, and a second end 36*f*. First bogie 36 has a longitudinal axis "Y" that extends between first end 36*e* and second end 36*f*. Specifically, the body of first bogie 36 is comprised of a primary equalizer beam 44, a secondary equalizer beam 46, and a drive system. As illustrated, the drive system comprises a pair of driven wheel assemblies 48. The first bogie 36 may also include a non-driven wheel assembly 50 and a connector bracket 52.

Figure 4:
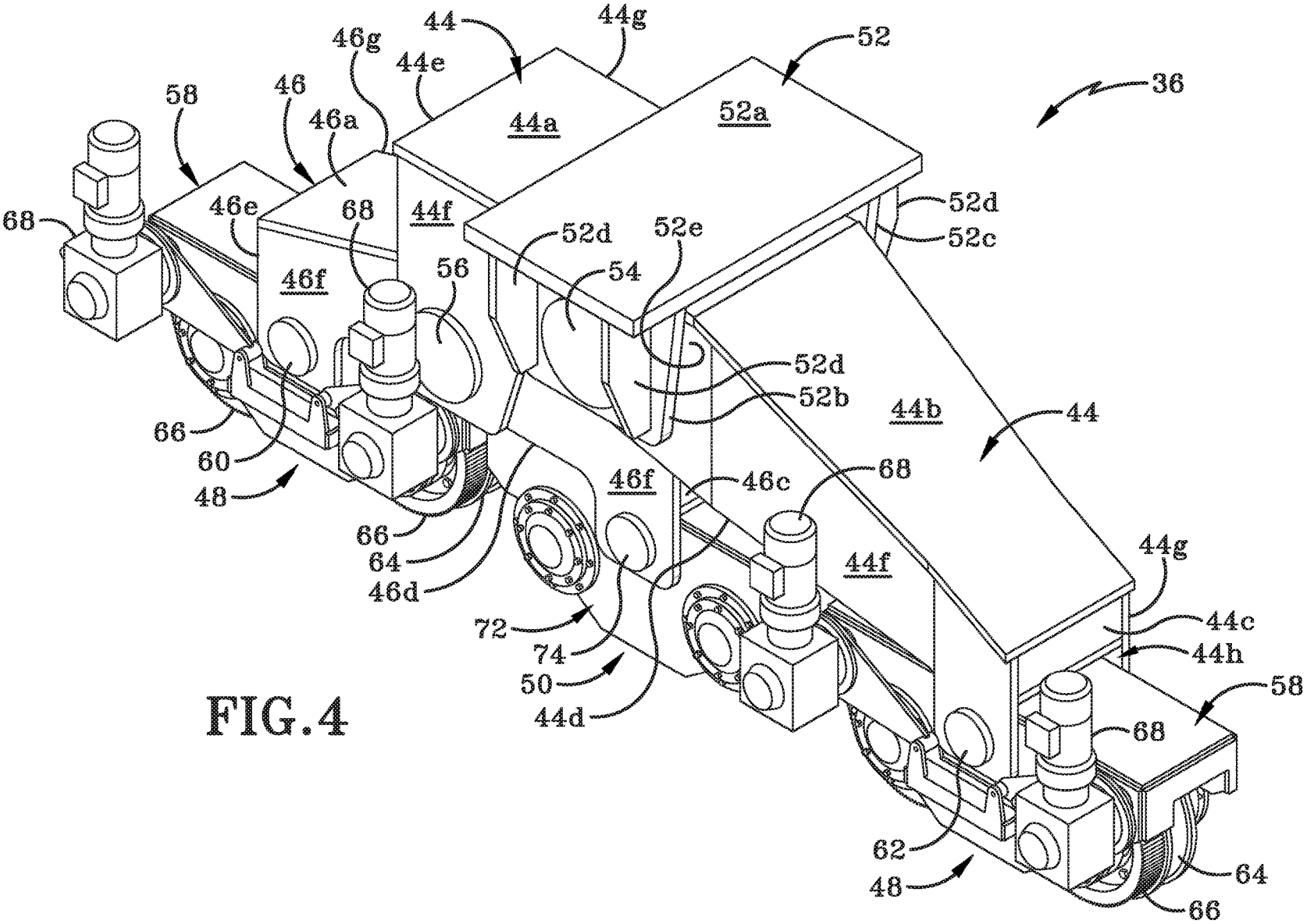
FIG. 4 is an isometric perspective view of the first bogie shown on its own.

FIG. 4 shows primary equalizer beam 44 includes a generally horizontal top surface 44*a*, an angled top surface 44*b*, a first end 44*c*, an angled lower surface 44*d*, and a second end 44*e*. A first side 44*f* and a second side 44*g* extend between the first end 44*c* and the second end 44*e*. First and second sides 44*f*, 44*g* extend downwardly for a distance below a lowermost edge of first end 44*c*, creating a gap 44h between first and second sides 44*f*, and 44*g*. In a similar fashion, first and second sides 44*f*, 44*g* extend downwardly for a distance between a lowermost edge of second end 44*e*, creating a gap (not shown) between first and second sides 44*f*, and 44*g*. Second equalizer beam 46 is received within the gap proximate second end 44*e*. Primary equalizer beam 44 defines three pairs of aligned apertures in first side 44*f* and second side 44*g*. These apertures are indicated in the figures as apertures 44*i*, 44*j*, and 44*k*.

Figure 3:
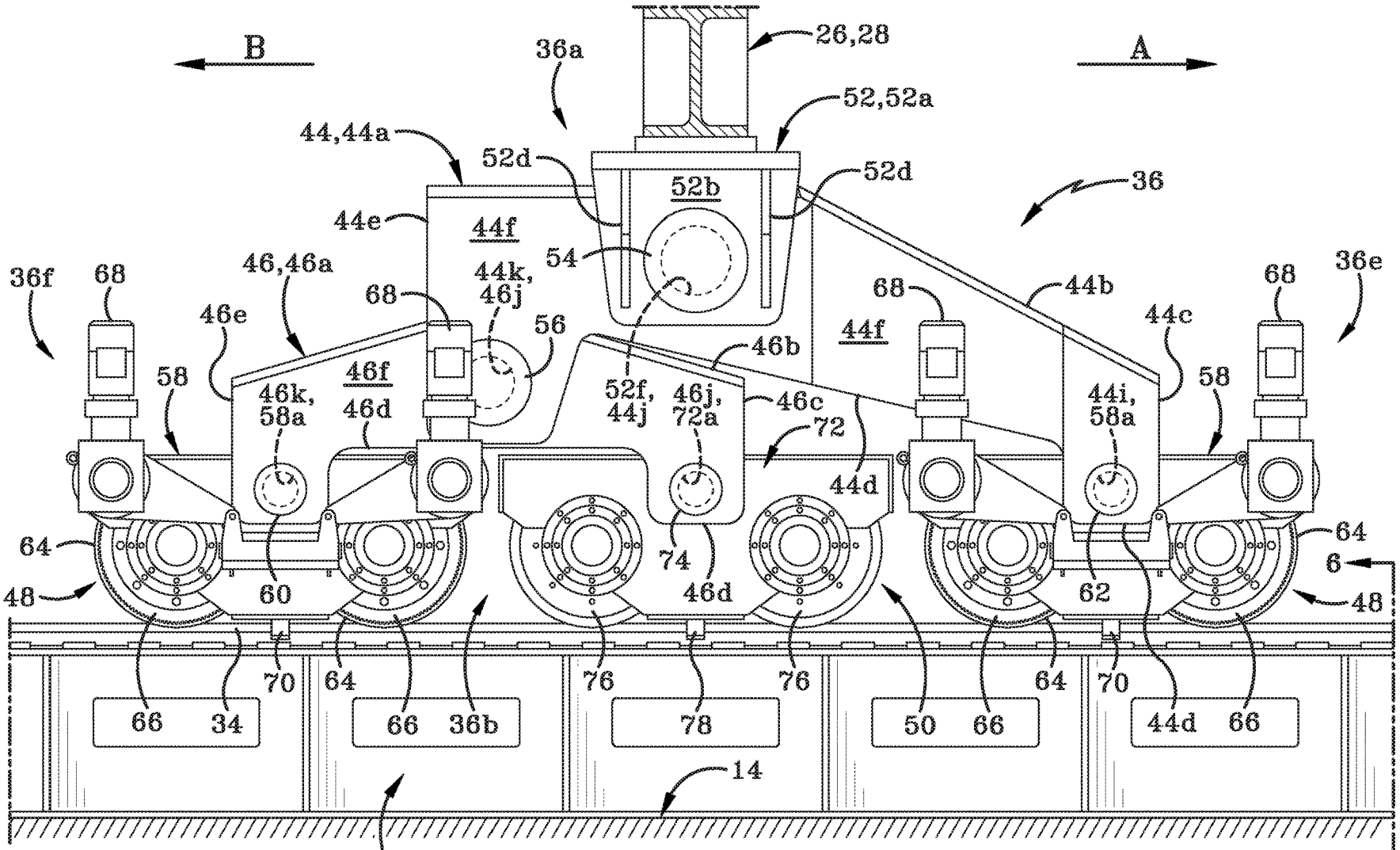
FIG. 3 is a side elevation view of a first bogie of the support assembly taken along line 3-3 of FIG. 2, with the first bogie shown engaged with a first rail mounted on a first girder and showing the fixed connection between the first bogie and a lowermost I-beam of the movable roof structure.

Referring to FIGS. 3-4, secondary equalizer beam 46 includes a first top surface 46*a* and a second top surface 46*b* (FIG. 3) that are oriented at an obtuse angle relative to each other. Second equalizer beam 46 also includes a first end 46*c*, a generally U-shaped lower surface 46*d*, and a second end 46*e*. A first side 46*f* and a second side 46*g* extend between first end 46*c* and rear end 46*d*. In much a similar manner to primary equalizer beam, first side 46*f* and second side 46*g* extend downwardly for a distance beyond a lowermost edge of first end 46*c* and second end 46*e*, creating a gap between the first side 46*f*, and second side 46*g*. One or more of wheel assemblies 48, 50 are received in this gap. Secondary equalizer beam defines three pairs of aligned apertures in first and second sides 46*f*, 46*g*. Those apertures are identified as apertures 46*h*, 46*j*, and 46*k*.

Connector bracket 52 includes a top plate 52*a*, a first side plate 52*b* and a second side plate 52*c* that each extend downwardly from a lower surface of top plate 52*a*. The width "W1" (FIG. 7) of top plate 52*a* may be approximately seven feet and the length "L1" of top plate 52*a* may be approximately four feet. A plurality of gussets 52*d* extend between an exterior surface of the first and second side plates 52*c* and the lower surface of top plate 52*a*. First and second side plates 52*b*, 52*c* are spaced a distance laterally from each other so that a gap 52*e* (FIGS. 4 and 5) is defined between them. As best seen in FIG. 3, a lower flange of I-beam 28 contacts an upper surface of top plate 52*a* and is secured thereto. In particular, the lower flange of I-beam 28 may be welded to top plate 52*a*. In other example, the lower flange of I-beam 28 may be bolted to or otherwise secured to top plate 52*a*. Because of this securement, first bogie 36 moves in unison with I-beam 28. Furthermore, because of this securement, first bogie 36 is immobile relative to I-beam 28.

The size of gap 52*e* in connector bracket 52 is sufficiently large enough that primary equalizer beam 44 may be received therein in an orientation that places top surface 44*a* proximate a lower surface of top plate 52*a* and the angled top surface 44*b* extends forwardly beyond first and second side plates 52*b*, 52*c* and towards first side 44*c*. First and second side plates 52*b*, 52*c* define a pair of aligned apertures 52*f* therein. When primary equalizer beam 44 is positioned in gap 52*e*, apertures 52*f* are aligned with apertures 44*j* and a first pin 54 is received therethrough. First pin 54 secures connector bracket 52 and primary equalizer beam 44 together. When secondary equalizer beam 46 is received in the gap 44h between first and second sides 44*f*, 44*g*, apertures 46*j* are aligned with apertures 44*k* and a second pin 56 is received therethrough. Second pin 56 secures primary equalizer beam 44 and secondary equalizer beam together.

As indicated earlier herein, first bogie 36 includes two driven wheel assemblies 48. Each of these driven wheel assemblies 48 may be of any type that is known in the art and therefore will only be described in general terms. A first wheel assembly 48 may include a body 58 that is sized to be received in the gap defined between first side 46*f* and second side 46*g* of secondary equalizer beam 46. A pair of aligned apertures 58*a* is defined in body 58. When wheel assembly 48 is received in the gap between first side 46*f* and second side 46*g*, apertures 58*a* are aligned with apertures 46*k* and a third pin 60 is received therethrough. Third pin 60 secures wheel assembly 48 to secondary equalizer beam 46.

A second wheel assembly 48 may include a body 58 that is sized to be received in the gap 44h between first side 44*f* and second side 44*g* of primary equalizer beam 44 as is shown in FIG. 4. The body 58 of second wheel assembly 48 defines a pair of aligned apertures 58*a* therein. When this second wheel assembly 48 is received in the gap 44h, the apertures 48*a* are aligned with apertures 44*i* and a fourth pin 62 is received through the aligned apertures 44*i*, 58*a*. Fourth pin 62 secures the second wheel assembly 48 to primary equalizer beam 44.

Figure 5:
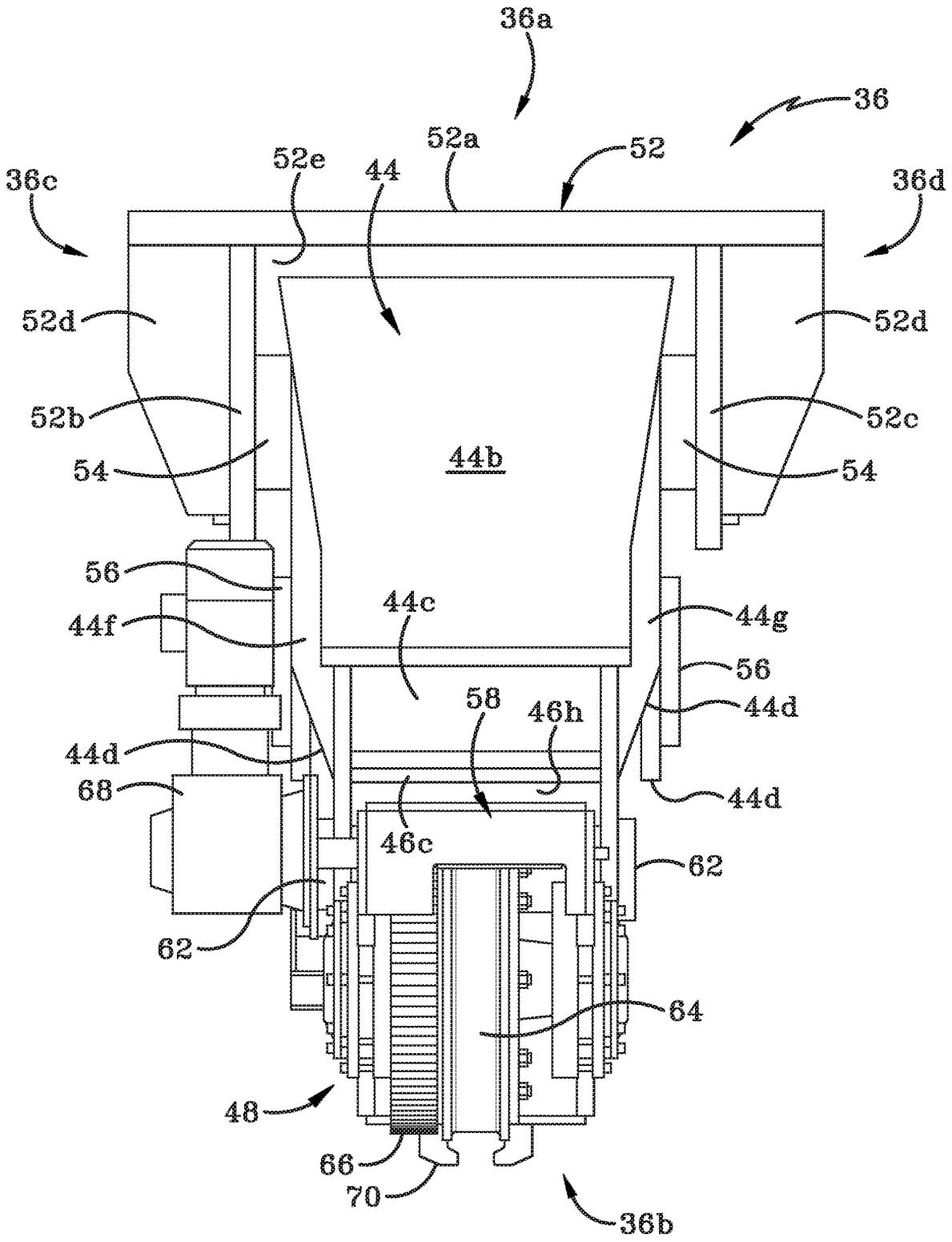
FIG. 5 is an elevation view of a first end of the first bogie.
Figure 6:
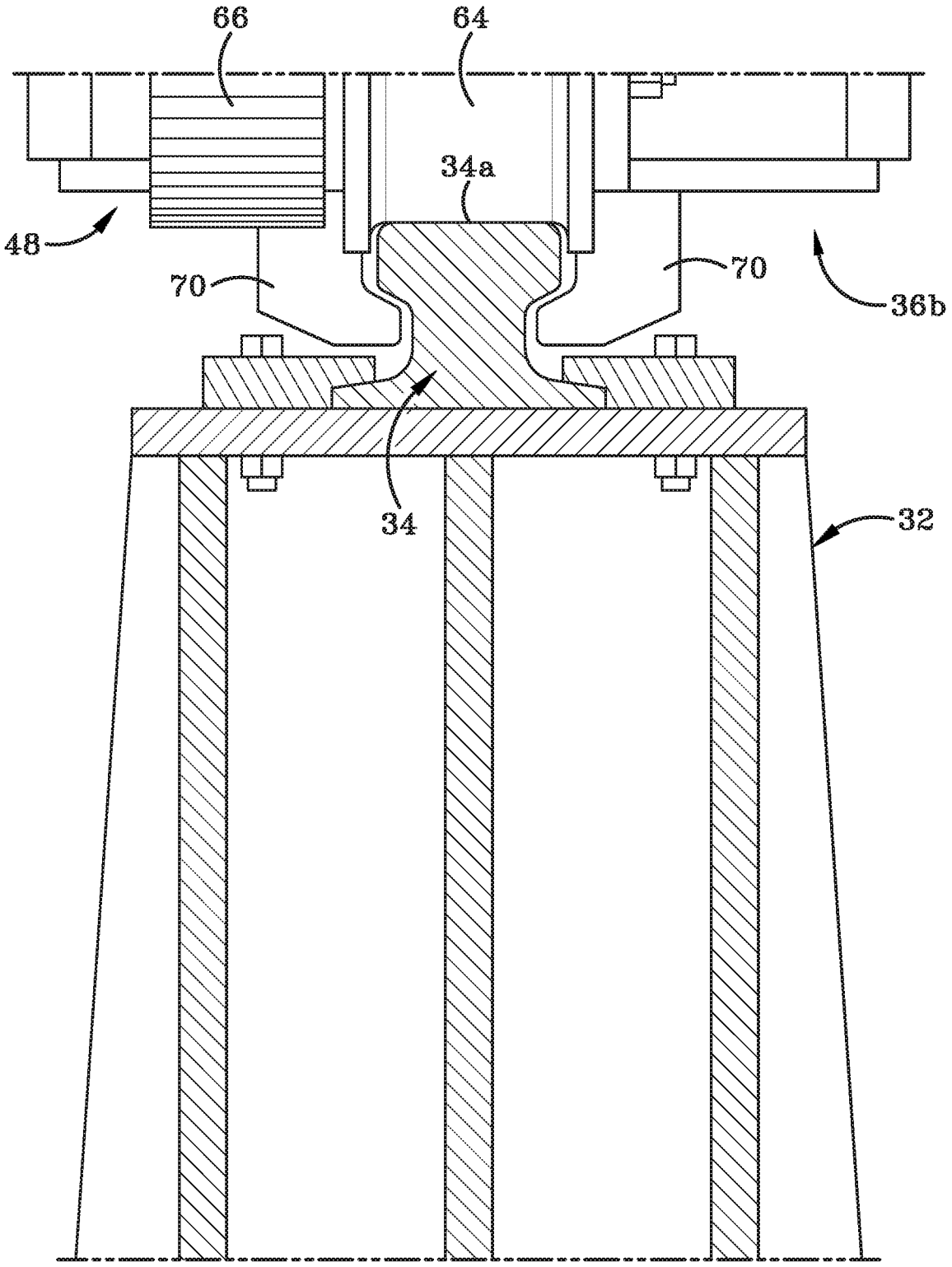
FIG. 6 is a cross-section of the bottom end of the first bogie showing the first bogie's engagement with the first rail and first girder.
Figure 7:
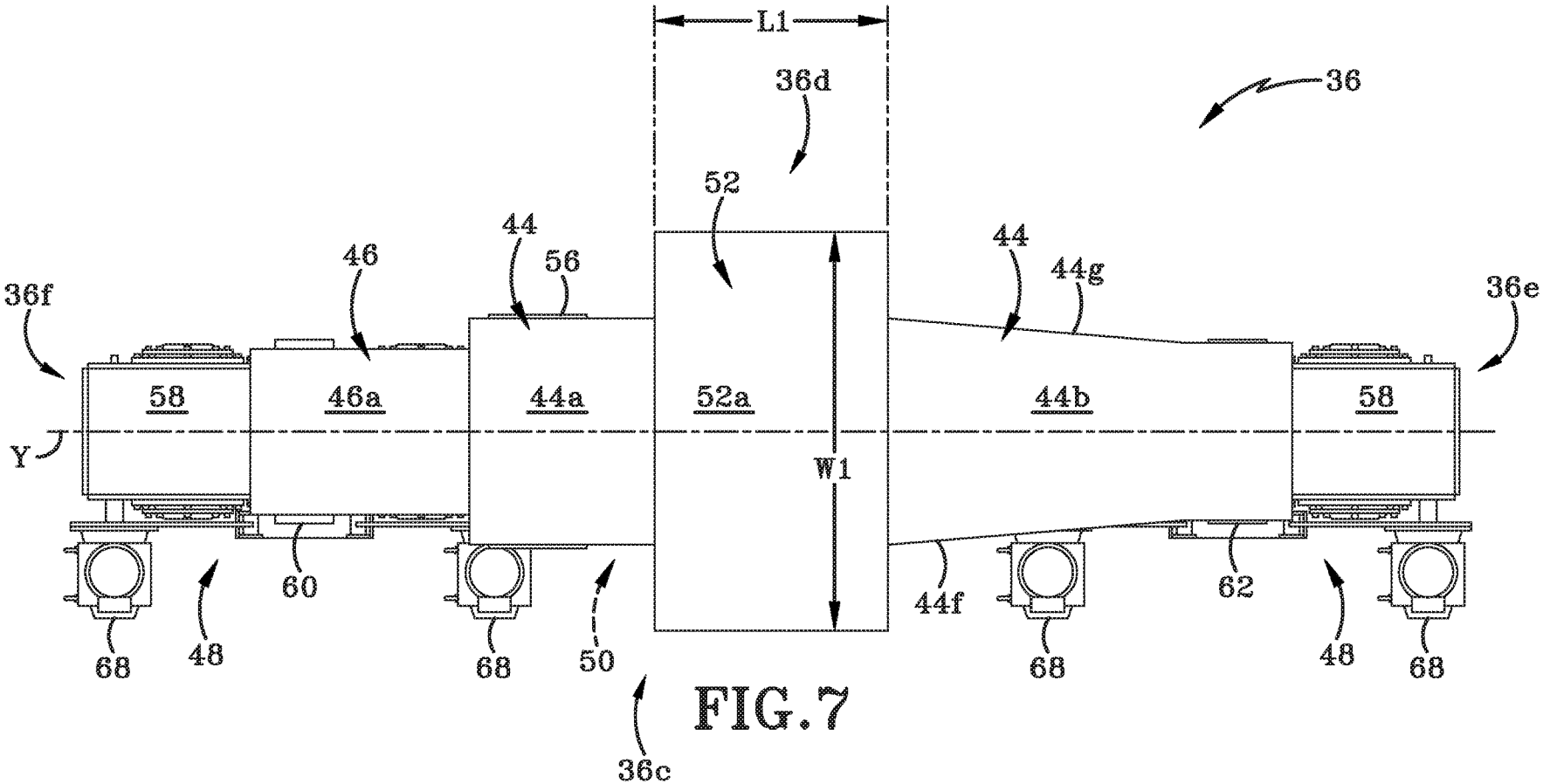
FIG. 7 is a top plan view of the first bogie.

FIG. 5 shows that each of the wheel assemblies 48 includes a pair of wheels 64 and gears 66 that are operatively engaged with drive gears, i.e., pinions (not shown). The drive gears or pinions which engage gears 66 are connected to and driven by the output shaft of a motor and commercial gear reducer combination, or gear motor 68. Each wheel assembly 48 further includes uplift clips 70 (FIG. 6). The purpose of uplift clips 70 is to prevent the roof from lifting off the rail 34 in heavy winds. Uplift clips 70 do not contact the rail 34 under normal rolling operation. There is typically about ¼ gap between the upper curved surface of the gripping mechanism, i.e. uplift clips 70, and the lower curved surface of the rail head and between the end surfaces of the gripping mechanism and sides of the rail web. The gripping mechanism is not intended to produce a downwardly biased force of the wheels against the rail 34; gravity is relied upon to do so. When uplift clips 70 engage first rail 34, wheels 64 are brought into contact with an upper surface 34*a* of first rail 34. Wheels 64 will roll along upper surface 34*a* when motors 68 are actuated. A brake assembly is provided at either end of first bogie 36. One of the brake assemblies is illustrated in phantom proximate one end of first bogie 36 in FIG. 3A.

Figure 3A:
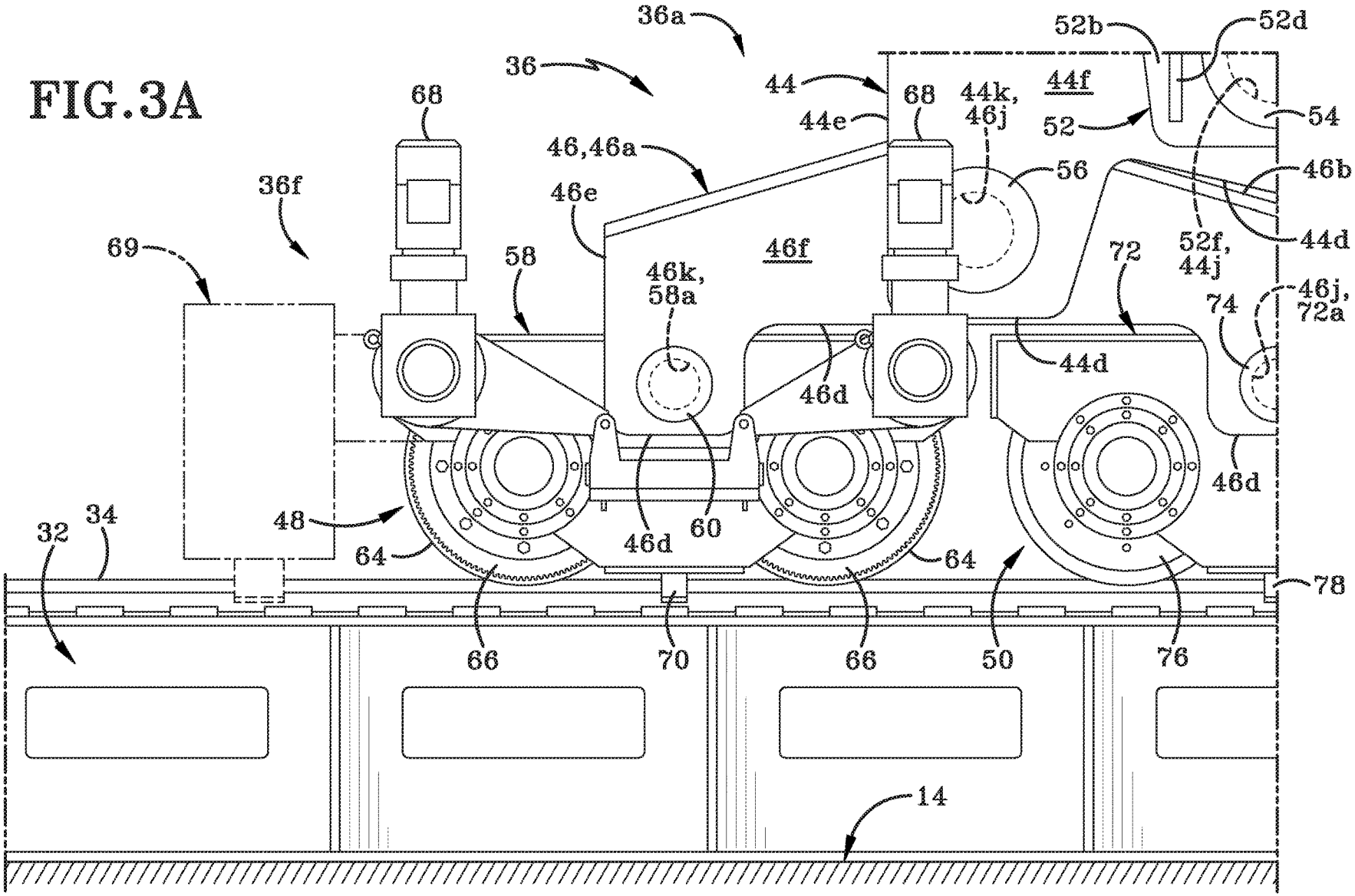
FIG. 3A is an enlarged side elevation view of one end of the first bogie of FIG. 3.

FIGS. 3A and 4 show that the non-driven wheel assembly 50 is located between the two driven wheel assemblies 48.

Non-driven wheel assembly 50 includes a body 72 that is sized to fit in the gap between the first side 46*f* and second side 46*g* of secondary equalizer beam 46. Body 72 defines a pair of aligned apertures 72*a* that are brought into alignment with apertures 46*j* in secondary equalizer beam 46 when non-driven wheel assembly 50 is positioned within the gap between first and second sides 46*f*, 46*g*. A fifth pin 74 is received through the aligned apertures 46*j*, 72*a* to secure secondary equalizer beam 46 and non-driven wheel assembly 50 together. Non-driven wheel assembly 50 further includes a pair of wheels 76 and an uplift clip 78. Non-driven wheel assembly 50 lacks motors and gears. The wheels 76 of non-driven wheel assembly 50 roll along the upper surface 34*a* of rail 34 when first bogie 36 is moved therealong by motors 68 on the two driven wheel assemblies 48.

As best seen in FIG. 3, first bogie 36 is engaged with first rail 34 that is mounted on first girder 32. As previously described, top plate 52*a* of connector bracket 52 of first bogie 36 is fixedly secured to I-beam 28 of truss assembly 26. This fixed connection may include welding the bottom flange of I-beam 28 and top plate 52*a* of first bogie 36 together, bolting top plate 52*a* and the bottom flange of I-beam 28 together, or otherwise securing them to each other. As has been described earlier herein, I-beam 28 forms part of the truss assembly 26 to which roof panel(s) 24 are secured. Consequently, fixedly securing I-beam 28 to first bogie 36 causes roof panel 24 and first bogie 36 to be operatively engaged with each other in a fixed manner. When first bogie 36 is driven along rail 34 in a first longitudinal direction "A" (FIG. 3) or in a second longitudinal direction "B" (FIGS. 3 and 13), I-beam 28 is caused to move in unison with first bogie 36. Consequently, the roof panel(s) 24 are moved in unison with the I-beam 28 and thereby with the first bogie 36 and in the same first longitudinal direction "A" or second longitudinal direction "B". Since the first girder 32 is oriented longitudinally and parallel to longitudinal axis "Y", the movable roof structure 16 moves in unison with first bogie 36 along a longitudinally-oriented pathway. That pathway is, in this particular instance, formed by first rail 34 mounted on first girder 32.

Depending on how the roof system is constructed, it could be beneficial in some examples to include an extended connector bracket 52 to assure simple pin loading on the primary equalizer. Without using a connector bracket as shown, the bearing load on the primary equalizer may not be (theoretically) perfectly centered as it is with a pin. This may result in unequal wheel loading which must be accounted for in the design. The elastomeric element in the expansion bearing is intended to help reduce any eccentricity effect.

FIGS. 8 to 11 show second bogie 42 in greater detail. FIGS. 8 to 11 therefore show the float bogie or slide bogie 42 in greater detail. Second bogie 42 is substantially identical to first bogie 36 except for specific features that will be described in greater detail hereafter. All other components of second bogie 42 are substantially identical in structure and function to the components of first bogie 36 and therefore will not be described in much detail hereafter.

Second bogie 42 comprises a body that generally has a top 42*a* (FIG. 9), a bottom 42*b*, a first side 42*c*, a second side 42*d*, a first end 42*e*, and a second end 42*f*. Second bogie 42 has a longitudinal axis "Y" (FIG. 11) that extends between first end 42*e* and second end 42*f*. Second bogie 42 also has a lateral axis "X" (FIG. 11) that extends from first side 42*c* to second side 42*d*, where the axis "X" is oriented at right angles to longitudinal axis "Y".

Like first bogie 36, second bogie 42 is also caused to move in a selected one of the first longitudinal direction "A" and the second longitudinal direction "B" along a longitudinally-oriented pathway. (It should be understood that both the first bogies 36 and the second bogies 42 will move in the same direction at the same time.) The longitudinal pathway that second bogies 42 travel is, in this particular instance, formed by second rail 40 mounted on second girder 38.

Figure 9:
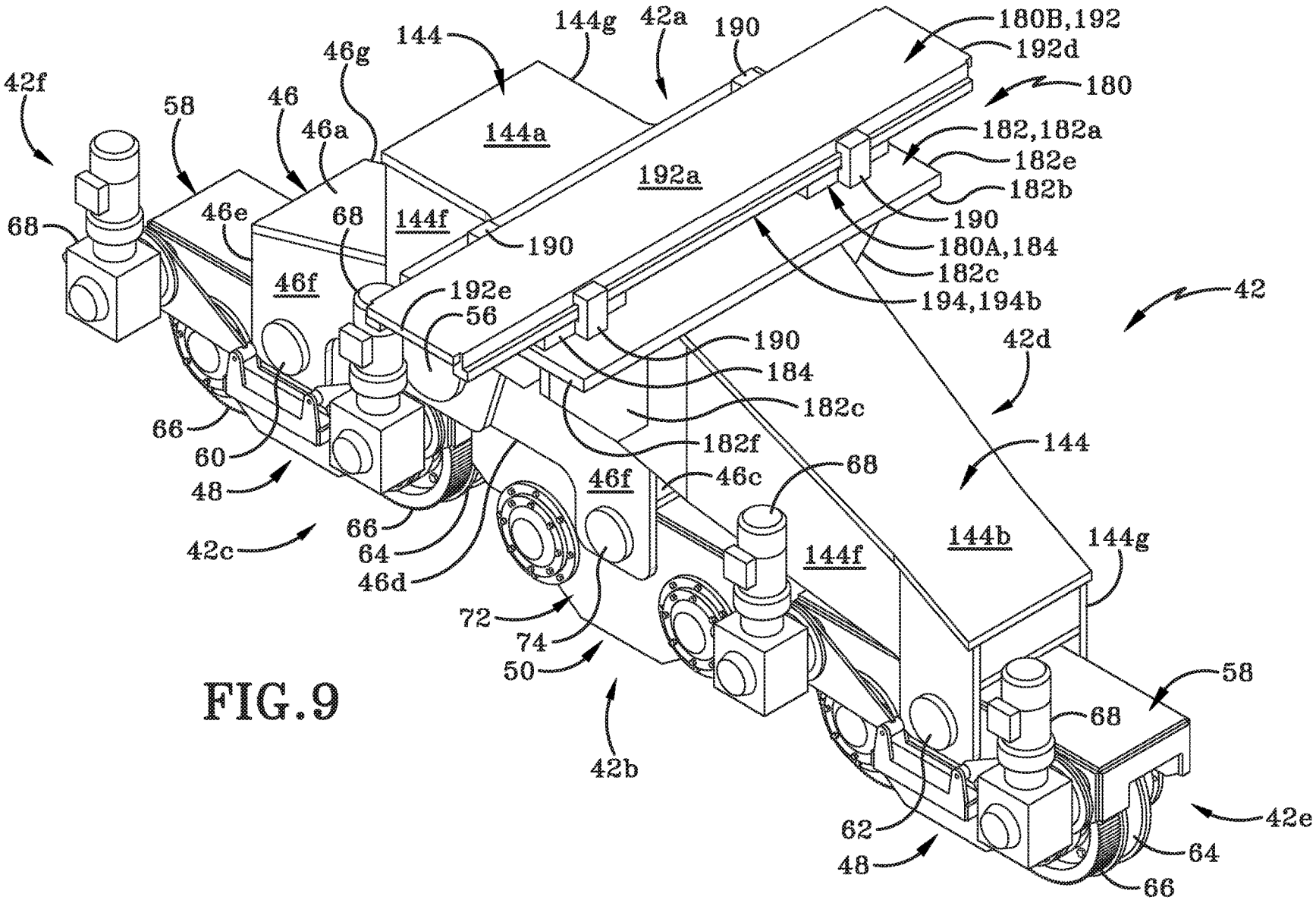
FIG. 9 is an isometric perspective view of the second bogie shown on its own.

As best seen in FIG. 9, the body of second bogie 42 is comprised of a primary equalizer beam 144, a secondary equalizer beam 46, a pair of driven wheel assemblies 48, and a non-driven wheel assembly 50. Second bogie 42 is substantially identical to first bogie 36 except that the primary equalizer beam 144 is configured slightly differently relative to primary equalizer beam 44 of first bogie 36. Additionally, second bogie 42 does not include the connector bracket 52 that is provided on first bogie 36. Instead, a bearing assembly 180 is provided on primary equalizer beam 144 and is configured for engagement with movable roof structure 16. In particular, bearing assembly 180 is a slide bearing assembly but it will be understood that in other examples, other types of bearing assembly may be utilized instead of a slide bearing assembly.

The differently configured primary equalizer beam 144 of second bogie 42 includes a generally horizontal top surface 144*a* and an angled top surface 144*b* that extends downwardly from top surface 144*a* and towards front end 42*e*. A support plate 182 is welded on top surface 144*a* immediately rearwardly of angled top surface 144*b*. Support plate 182 has an upper surface 182*a* (FIG. 8) and a lower surface 182. A plurality of gussets 182*c* are welded to first and second side surfaces 144*f*, 144*g* of primary equalizer beam 144 and to the lower surface 182*b* of support plate 182. A first pair of spaced-apart gussets 182*c* are engaged with first side surface 144*f* of primary equalizer beam 144 and a second pair of gussets 182*c* are engaged with second side surface 144*g* of primary equalizer beam 144. It should be noted that gussets 182*c* are more robust than the gussets 52*d* on connector bracket 52 of first bogie 36. Gussets 182 may therefore be longer, thicker and/or taller than gussets 52*d*. A brace 182*d* extends between the gussets 182*c* of each pair. Brace 182*d* may be spaced a distance laterally away from the associated first side surface 144*f* and second side surface 144*g*.

Second bogie 42 differs from first bogie 36 in that support plate 182 on second bogie 42 is wider and longer than top plate 52 on first bogie 36. As indicated earlier herein, top plate 52*a* may be of a width "W1" (FIG. 7) of about seven feet and of a length "L1" of approximately four feet. Support plate 182 may be of a width "W2" (FIG. 11) of about nine feet, where the width "W2" is the distance between edge 182*e* and edge 182*f* of support plate 182. Support plate 182 therefore extends for a distance laterally outwardly beyond the first and second side surfaces 144*f* and 144*g* of primary equalizer beam 144. The gussets 182*c* are engaged with the overhanging portions of support plate 182. Support plate 182 may be of a length "L2" (FIG. 11) of about four-and-a-half feet. Support plate 182 has a thickness (measured from upper surface 182*a* to lower surface 182*b*) that is greater than the thickness of top surface 144*a* of primary equalizer beam 144. (The thickness of top surface 144*a* is also measured from the upper surface of top surface 144*a* to a lower surface thereof.) In one example, the thickness of support plate 182 may be about three inches while the thickness of top plate 144*a* may be about two inches. The bearing assembly 180 is engaged between support plate 182 and I-beam 28. Support plate 182 is thicker than top surface 144*a* because the support plate 182 is required to bear a load thereon at a greater distance from the web of the I-beam 28 where shear is transferred than is the case with top plate 52 of first bogie 36. This arrangement results in larger bending moments on the support plate 182, thus requiring that the gussets 182*c* engaged with support plate 182*e* being larger than the gussets 52*d* required with top plate 52. The important functionality is that the lateral extensions on the primary equalizer beam 144, i.e., the lateral extensions of support plate 182 are designed to take the eccentric load of the movable roof structure 16 and transfer that load back to the main body of the equalizer beam 144. From there the load is transferred down through the web plates of the second bogie 42 to the lower pin connectors 60, 62, 74.

A further difference between first bogie 36 and second bogie 42 is that the primary equalizer beam 144 does not include apertures 44*j* and the first pin 54 that are present on first bogie 36. In another example, the upper portion of the primary equalizer beam 144 on the second bogie 42 could be configured to utilize a connector like top plate 52 except with that connector being strengthened to resist the eccentric load of the bearing assembly 180 and movable roof structure 16. In this example, a pin similar to the first pin 54 would also be required. Additionally, in this case, the bearing assembly 180 would be configured with a larger footprint in plan for stability.

All other parts of second bogie 42, e.g. secondary equalizer beam 46, driven wheel assemblies 48 and non-driven wheel assembly 50 are substantially identical in structure and function to those same components on first bogie 36

As indicated earlier herein, a bearing assembly 180 operatively engages movable roof structure 16 and second bogie 42. The bearing assembly 180 is provided to enable movable roof structure 16 to expand or contract in length as a result of a changes in temperature, i.e., changing thermal conditions, without interfering with the ability to move the movable roof structure 16 between the first position and the second position. The bearing assembly 180 that is utilized in the present disclosure preferably is a commercially available bearing assembly. For example, one suitable bearing assembly is a commercially available bridge-style bearing such as the Uplift Bridge Bearing manufactured by RJ Watson Inc. of Alden, N.Y., USA.

Figure 8:
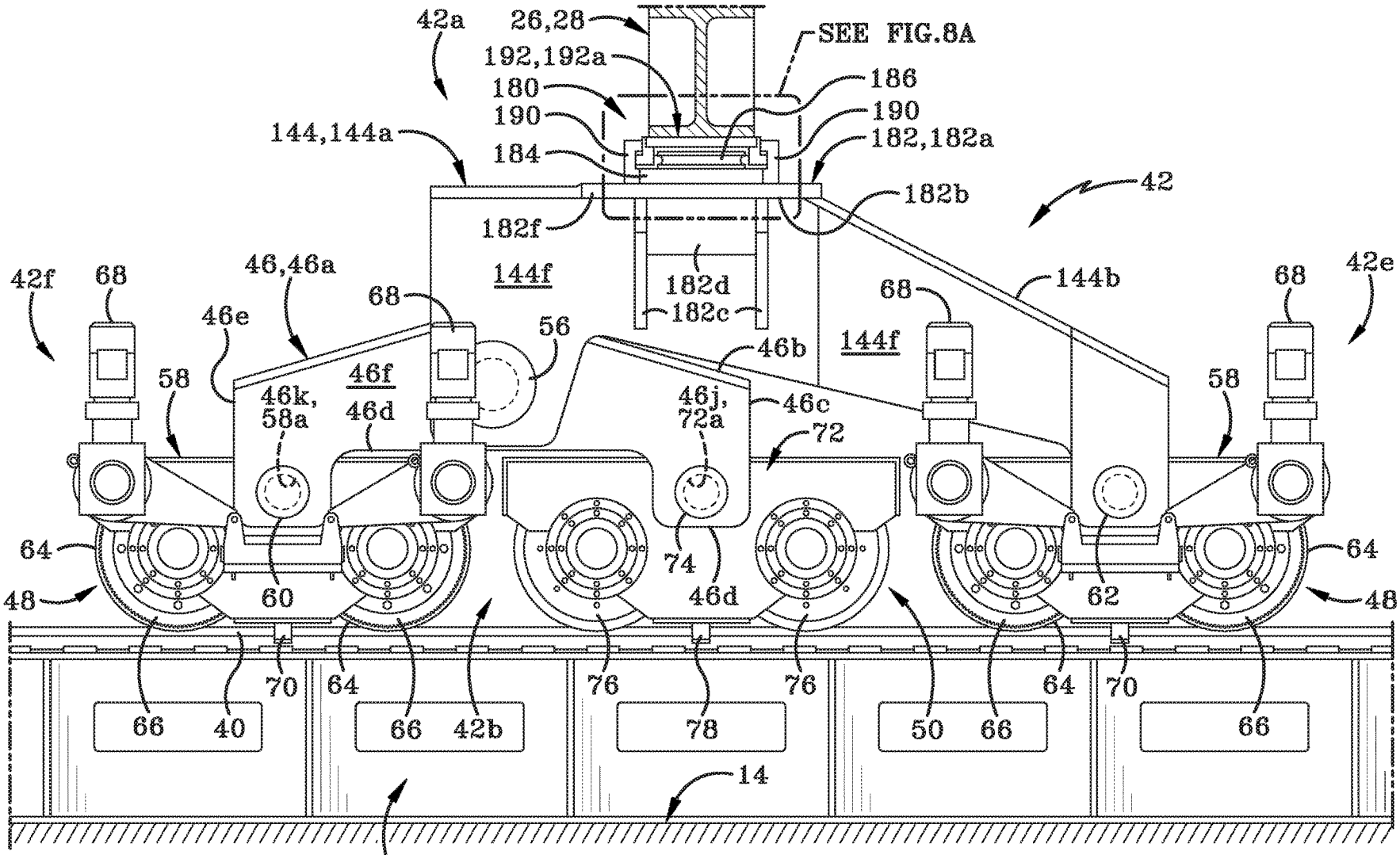
FIG. 8 is a side elevation view of a second bogie of the support assembly taken along line 8-8 of FIG. 2, with the second bogie shown engaged with a second rail mounted on a second girder, and showing a slide bearing operatively engaging the second bogie to the lowermost I-beam of the movable roof structure.
Figure 10:
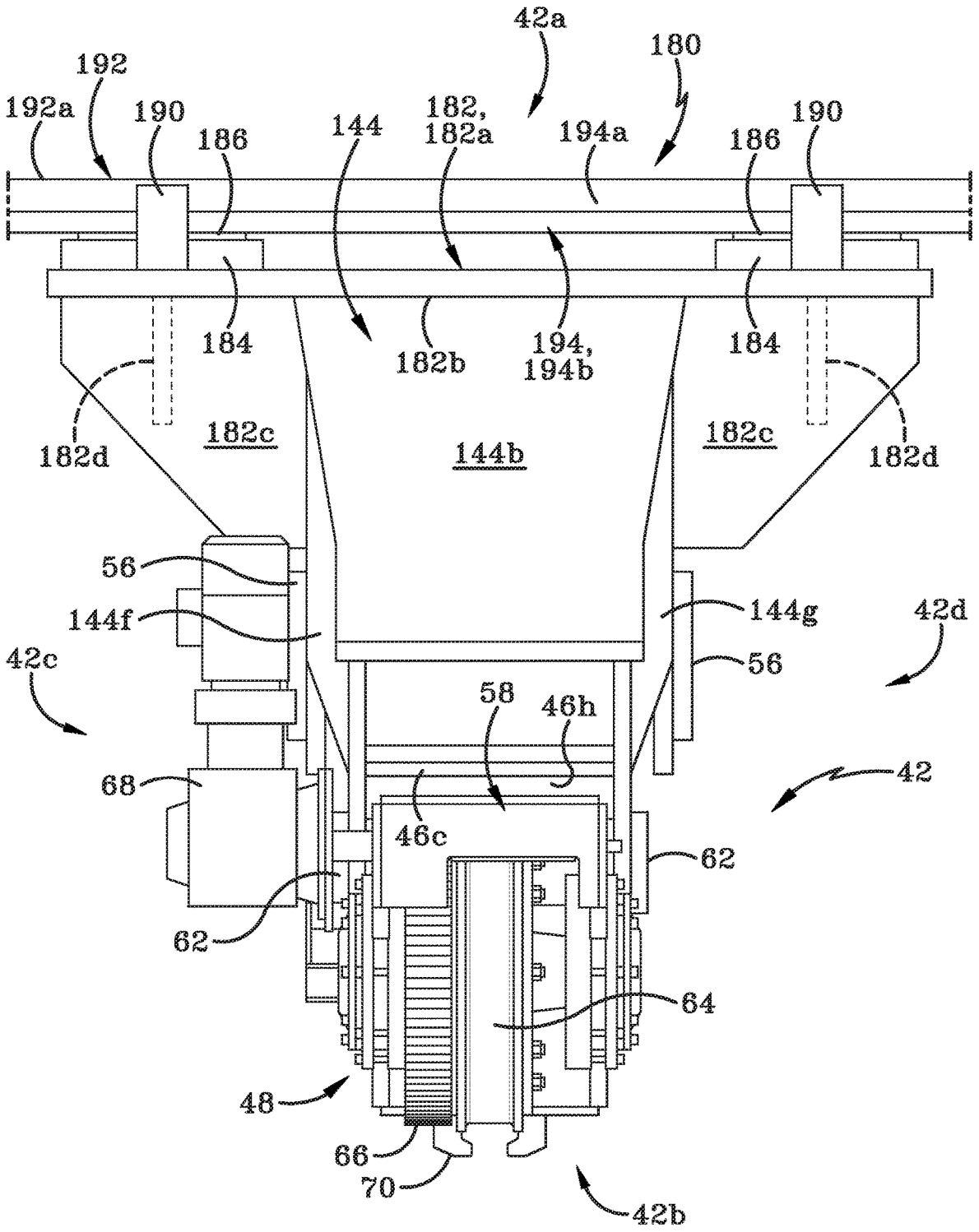
FIG. 10 is an elevation view of a first end of the second bogie.

Referring to FIGS. 8 to 10, a simplified exemplary bearing assembly 180 is shown in greater detail. Bearing assembly 180 comprises one or more lower bearing plates 184 that are positioned on support plate 182, a disc element 186 positioned on each lower bearing plate 184, a first layer 188 of a low friction or friction reducing material applied over the upper surface of the disc element 186, a pair of opposed first guides 190, an upper bearing plate 192, second guides 194 that extend downwardly from upper bearing plate 192, a slider plate 196 that is positioned vertically below the upper bearing plate 192, and a second layer 198.

Figure 11:
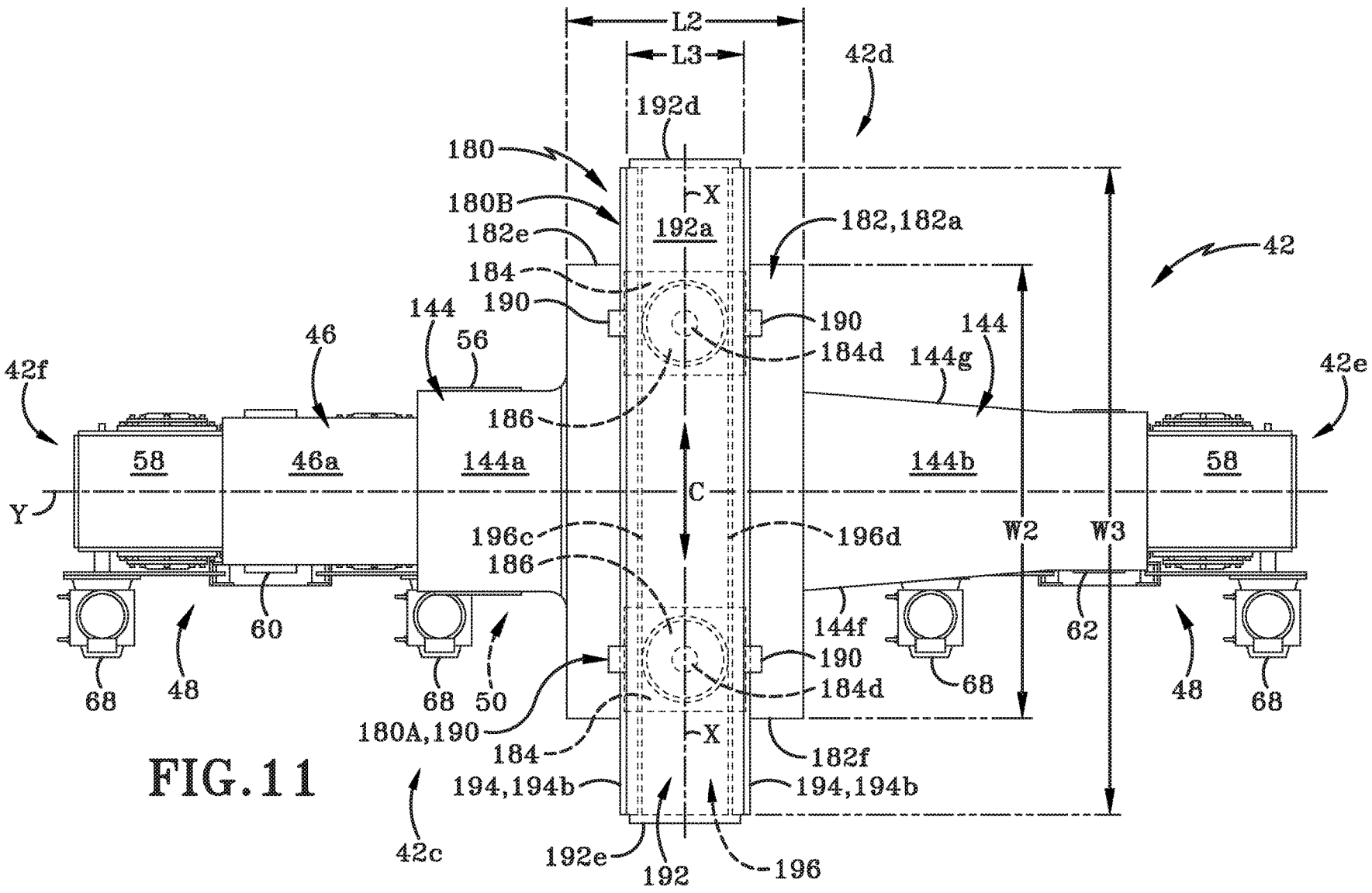
FIG. 11 is a top plan view of the second bogie shown in a neutral position.

FIG. 9 shows that bearing assembly 180 includes a pair of laterally spaced-apart lower bearing plates 184 that are positioned on upper surface 182*a* of support plate 182. Each lower bearing plate 184 has an upper surface 184*a* (FIG. 8A), a lower surface 184*b*, and a side surface 184*c* extending between upper and lower surfaces 184*a*, 184*b*. A shear pin 184*d* (FIG. 11) extends upwardly from a central region of each lower bearing plate 184. The lower surface 184*b* of each lower bearing plate 184 is welded to upper surface 182*a* of support plate 182. Each lower bearing plate 184 may be positioned such that a midline thereof is generally located a distance vertically above one of the braces 182*d*. Each lower bearing plate 184 may be generally square in shape when viewed from above (FIG. 11). It will be understood that the two lower bearing plates 184 may, instead be replaced with a single lower bearing plate that extends for substantially the entire width "W2" of support plate 182.

Each disc element 186 is positioned above one of the lower bearing plates 184. Disc element 186 comprises an elastomeric element, particularly a polyether urethane load element and may be generally rectangular or generally circular in shape when viewed from above (FIG. 11). Each disc element 186 includes an upper surface 186*a* (FIG. 8A), a lower surface 186*b*, and an annular side surface 186*c* that extends between upper and lower surfaces 186*a*. A central aperture (not numbered) extends from upper surface 186*a* through to lower surface 186*b*. The pin 184*d* of the associated lower bearing plate 184 is received through this central aperture. Shear pin 184*d* may be a high strength machined shear pin capable of transferring horizontal loads from the upper bearing plate to the lower bearing plate 184 and helps to isolate shear loads from the disc element 186 while allowing rotation.

Annular side surface 186*c* of disc element 186 may be at least partially concavely curved such as by forming an annular groove in the same. The groove allows disc element 186 to deform without bulging out on the side surfaces 186*c* when the load of the movable roof structure 16 is transferred onto second bogie 42. The elastomeric nature of disc element 186 allows small rotation release about all three axes of rotation when bearing assembly 180 is loaded. By utilizing such disc elements 186, the bearing assembly 180 may be able to accommodate vertical design loads of 10,000 to 15,000 kips or more while maintaining the disc element's ability to provide rotation.

It will be understood that while two spaced-apart disc elements 186 are illustrated as being used in bearing assembly 180, in other examples only a lower bearing plate and a single disc element 186 may be utilized. In other examples more than two disc elements 186 may be utilized on one or more lower bearing plates.

A first layer 188 of a low-friction material or a friction-reducing material such as polytetrafluoroethylene (PTFE) is applied to upper surface 186*a* of each disc element 186 and to the upper portions of the annular side surface 186*c* thereof. PTFE is marketed under the trademark TEFLON®; a registered trademark of THE CHEMOURS COMPANY FC, LLC of Wilmington, Del., US.

Figure 8A:
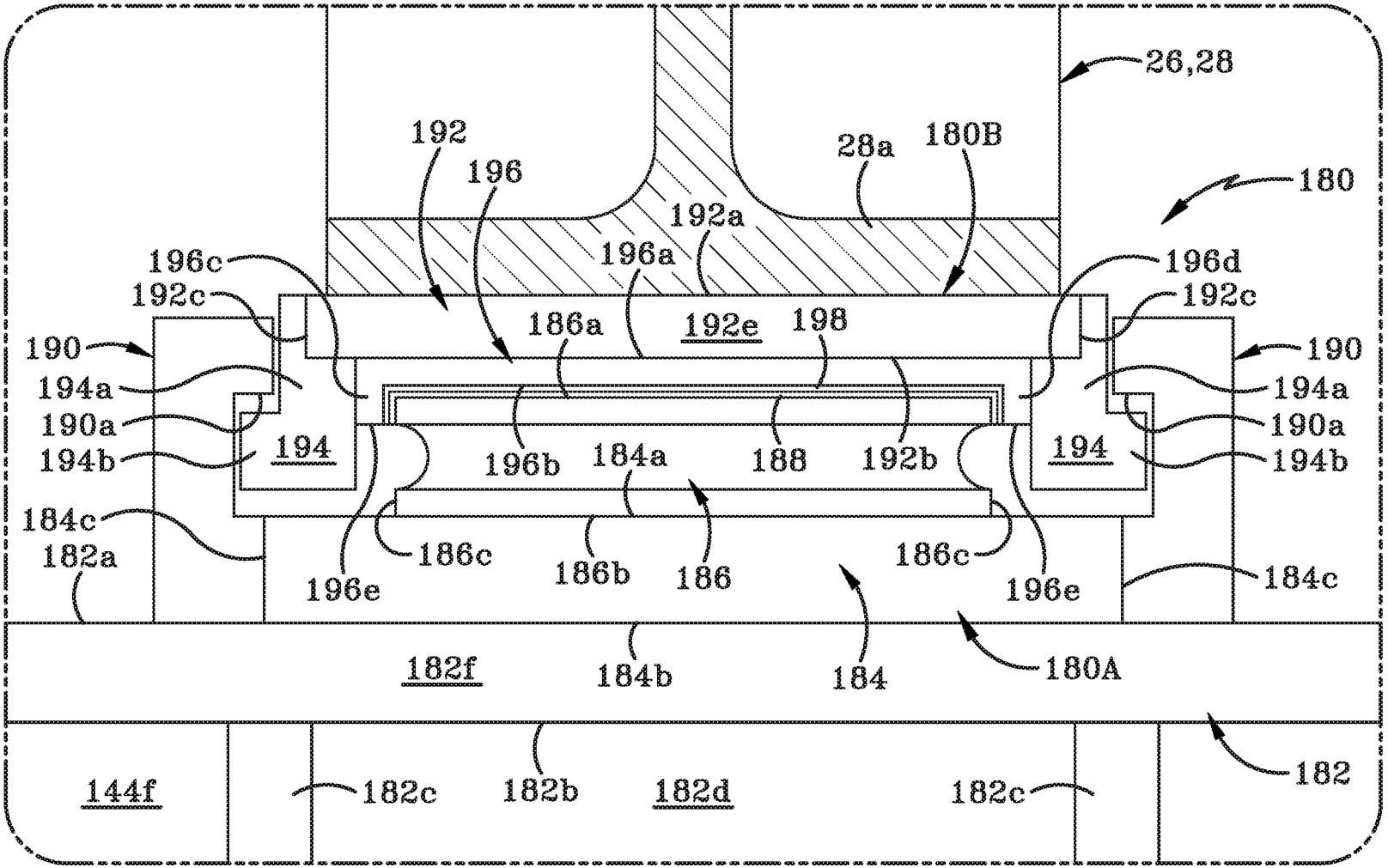
FIG. 8A is an enlarged side elevation view of the highlighted region of FIG. 8.

As can be seen from FIGS. 8A and 9, bearing assembly 180 further includes at least two pairs of opposed guided 190 that are welded to upper surface 182*a* of support plate 182. First guides 190 are additionally welded to outer side surfaces 184*c* of each lower bearing plate 184. Each first guide 190 is generally U-shaped when second bogie 42 is viewed from a first side as in FIGS. 8 and 8A. Each first guide 190 defines a channel 190*a* therein that will be discussed later herein.

Support plate 182, lower bearing plate 184, disc elements 186, first layer 188 of PTFE, and first guides 190 are secured together as described above, and move in unison with second bogie 42. Support plate 182, lower bearing plate 184, disc elements 186, first layer 188 of PTFE, and first guides 190 may be considered as a first member of bearing assembly 180. The first member is represented by the reference number 180A in FIGS. 14 and 15.

Referring to FIGS. 8 through 11, bearing assembly 180 further comprises an upper bearing plate 192 that has an upper surface 192*a* and a lower surface 192*b*. Upper bearing plate 192 further includes opposed side surfaces 192*c* that extend between upper and lower surfaces 192*a*, 192*b*. As best seen in FIG. 11, upper bearing plate 192 has a width "W3" measured from a first edge 192*d* to a second edge 192*e*. Width "W3" is greater than the width "W2" of support plate 182. Upper bearing plate 192 has a length "L3" that is less that the length "L2" of support plate 182. Width "W3" may be about thirteen feet while length "L3" may be about two feet.

Upper surface 192*a* of upper bearing plate 192 is welded to lowermost flange 28*a* of I-beam 28. A second guide 194 is welded to each side surface 192*c* and to an outermost region of bottom surface 192*b* of upper bearing plate 192. Each second guide 194 runs for substantially the entire width "W3" of upper bearing plate 192. Each second guide 194 is generally L-shaped when viewed from a first side as in FIG. 8A and the two second guides 194 are arranged as mirror images of each other on upper bearing plate 192. Each second guide 194 is comprised of a vertically-oriented first leg 194*a* and a horizontally-oriented second leg 194*b*. Second guides 194 are oriented such that the second legs 194*b* thereof extend outwardly from sides 192*c* of upper bearing plate 192 in opposite directions from each other. Second leg 194*b* of each second guide 194 is positioned to be received in channel 190*a* of the associated first guide 190 that extends upwardly from support plate 182. As can be seen from FIG. 8A, the depth of each channel 190*a* is greater than the height of the second leg 194*b* received therein.

Bearing assembly 180 further includes a slider plate 196 that is engaged with upper bearing plate 192. Slider plate 196 may be generally an inverted U-shape in cross-section and includes an upper surface 196*a*, a lower surface 196*b*, a first leg 196*c*, and a second leg 196*d*. First and second legs 196*c*, 196*d* originate at upper surface 196*a* and extend downwardly for a distance beyond lower surface 196*b*. Upper surface 196*a* is welded to lower surface 192*b* of upper bearing plate 192. The outer surfaces of first and second legs 196*c* and 196*d* are welded to second guide 194. As can be seen from FIG. 8A, second guides 194 extend downwardly for a distance beyond the lowermost ends 196*e* of the first and second legs 196*c*, 196*d*. First leg 196*c* and second leg 196*d* define a gap therebetween in that they are spaced a distance longitudinally apart from each other. The distance between first leg 196*c* and second leg 196*d* is only slightly greater than the diameter of each disc element 186. Disc elements 186 are received in the gap defined between first leg 196*c* and second leg 196*d*. It should be noted that slider plate 196 is of a length sufficient to extend outwardly beyond both disc elements 186 at all times.

Slider plate 196 is fabricated from stainless steel. The lower surface 196*b* and the inner surfaces of first leg 196*c* and second leg 196*d* are polished to a mirror finish to provide a friction-reducing surface or low-friction surface. That mirror finish is identified in FIG. 8A as the second layer 198 that extends over the lower surface 196*b* and inner surfaces of first leg 196*c* and second leg 196*d*. The second layer 198 is in abutting contact with first layer 188. As indicated earlier herein with reference to FIG. 8A, second guides 194 extend downwardly for a distance beyond the lowermost ends 196*e* of the first and second legs 196*c*, 196*d*. This configuration helps to ensure that there is very little space between first layer 188 and second layer 198 and helps to prevent dust particles from entering any gap between the two layers 188, 198.

Upper bearing plate 192, second guides 194, and slider plate 196 are fixedly secured to each other and move in unison with each other. Since lower flange 28*a* of I-beam 28 is welded to upper bearing plate 192, movable roof structure 16 will move in unison with upper bearing plate 192 and vice versa. Upper bearing plate 192, second guides 194, and slider plate 196, may be considered to be a second member of bearing assembly 180. This second member of the bearing assembly 180 is identified by the reference number 180B in FIGS. 14 and 15. Contact between the first member 180A and the second member 180B of bearing assembly 180 occurs at the interface of first layer 188 of PTFE and the mirror polished finish of the stainless steel of second layer 198. The first and second layers 188, 198 provide a low-friction interface that allows the second member 180B of bearing assembly 180 to readily and easily slide relative to the first member 180A of bearing assembly 180.

Because roof panel 24 and/or truss assembly 26 of movable roof structure 16 are fabricated partially or completely from metal, when movable roof structure 16 is exposed to heat or to cold, the roof panel 24 and/or truss assembly 26 may undergo thermal expansion (when heated) or thermal contraction (when cooled). The thermal expansion tends to make the roof panel 24 and/or truss 26 "grow" longer while thermal contraction tends to make the roof panel 24 and/or truss 26 "grow" shorter. Since the second member 180B (FIG. 14) of the bearing assembly 180 on each of the second bogies 42 is secured to truss assembly 26 via I-beam 28, as the roof panel 24 and/or truss 26 "grows" longer or "grows" shorter, second member 180B of bearing assembly 180 will tend to move in unison with the I-beam 28. Second member 180B will therefore tend to slide relative to the first member 180A of bearing assembly 180 along the low-friction first and second layers 188 and 198. The structure and function of the first member 180A of second bogie 42 will be relatively unaffected by the "growth" of movable roof structure 16. In other words, the increase in length of the movable roof structure 16 in hot conditions will not tend to affect the engagement of the second bogies 42 have with the rails 34, 40. Additionally, the decrease in length of the movable roof structure in cold conditions will not tend to affect the engagement of the second bogies 42 with the rails 34, 40. The second bogies 42 will therefore be able to open or close the movable roof structure 16 regardless of the growth of the roof in response to temperature.

The functioning of the bearing assembly 180 in response to temperature changes will be discussed in greater detail hereafter. As indicated earlier herein, second member 180B of bearing assembly 180 is fixedly secured to movable roof structure 16 and will move in unison therewith. Second member 180B of bearing assembly 180 will be in a neutral position when the movable roof structure 16 is in a neutral position, i.e., not undergoing changes in length due to temperature. Second member 180B of bearing assembly 180 may be moved in a lateral first direction "C1" (FIG. 11A and 14) if the movable roof structure 16 is undergoing thermal expansion and is increasing in length. Second member 180B of bearing assembly 180 may be moved in a lateral second direction "C2" (FIG. 15) if the movable roof structure 16 is undergoing thermal contraction and is decreasing in length. The sliding motion of second member 180B relative to first member 180A in either of the lateral first direction "C1" or the lateral second direction "C2" is made possible because of the low-friction interface between the polished layer 198 on slider plate 198 and the PTFE layer 188. It should be noted that because the first bogies 36 do not include bearing assemblies, the end of the movable roof structure 16 that is engaged by first bogies 36 tends to remain fixed in position and the changes in the length of the movable roof structure 16 is accommodated by the end of the roof structure that is engaged by second bogies 42. In other words, the direction of thermal expansion is controlled.

FIGS. 2 and 11 show the second member 180B of the bearing assembly 180 in the neutral position. In the neutral position, the second member 180B is generally centered over support plate 182 and, in particular, the upper bearing plate 192 is generally centered over support plate 182. In other words, the edges 192*d*, 192*e* are located generally at the same distance away from the associated edges 182*e*, 182*f* of support plate 182.

The potential lateral movement of second member 1806 away from the neutral position is indicated by arrows "C" in FIG. 11. Lateral movement of second member 180B in either direction "C" is along a movement axis that is substantially parallel to lateral axis "X" of the body of second bogie 42 and therefore at right angles to longitudinal axis "Y" of the body of second bogie 42.

Figure 11A:
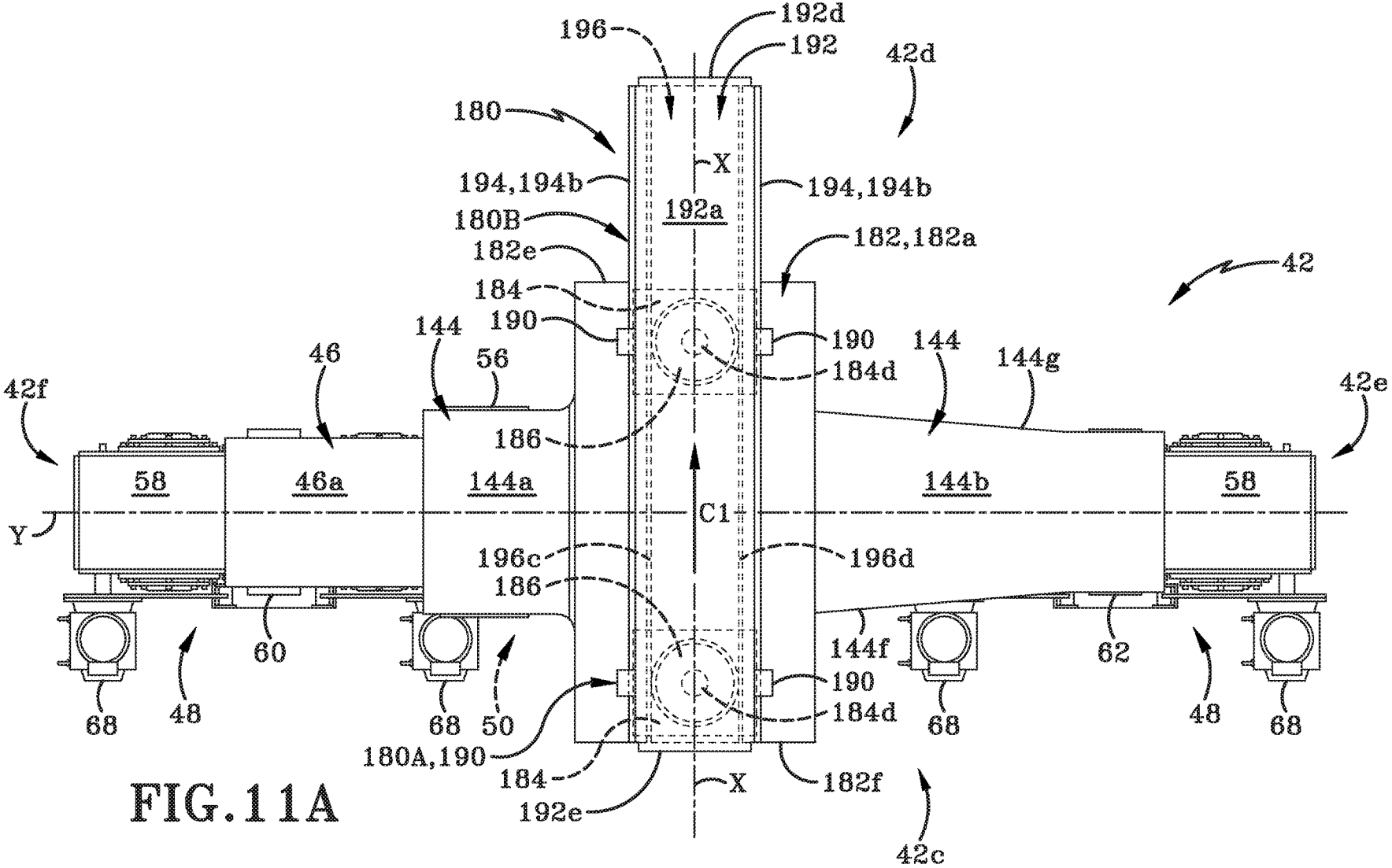
FIG. 11A is a top plan view of the second bogie showing the slider plate moved laterally relative to the rest of the slide bearing assembly and the second bogie.
Figure 14:
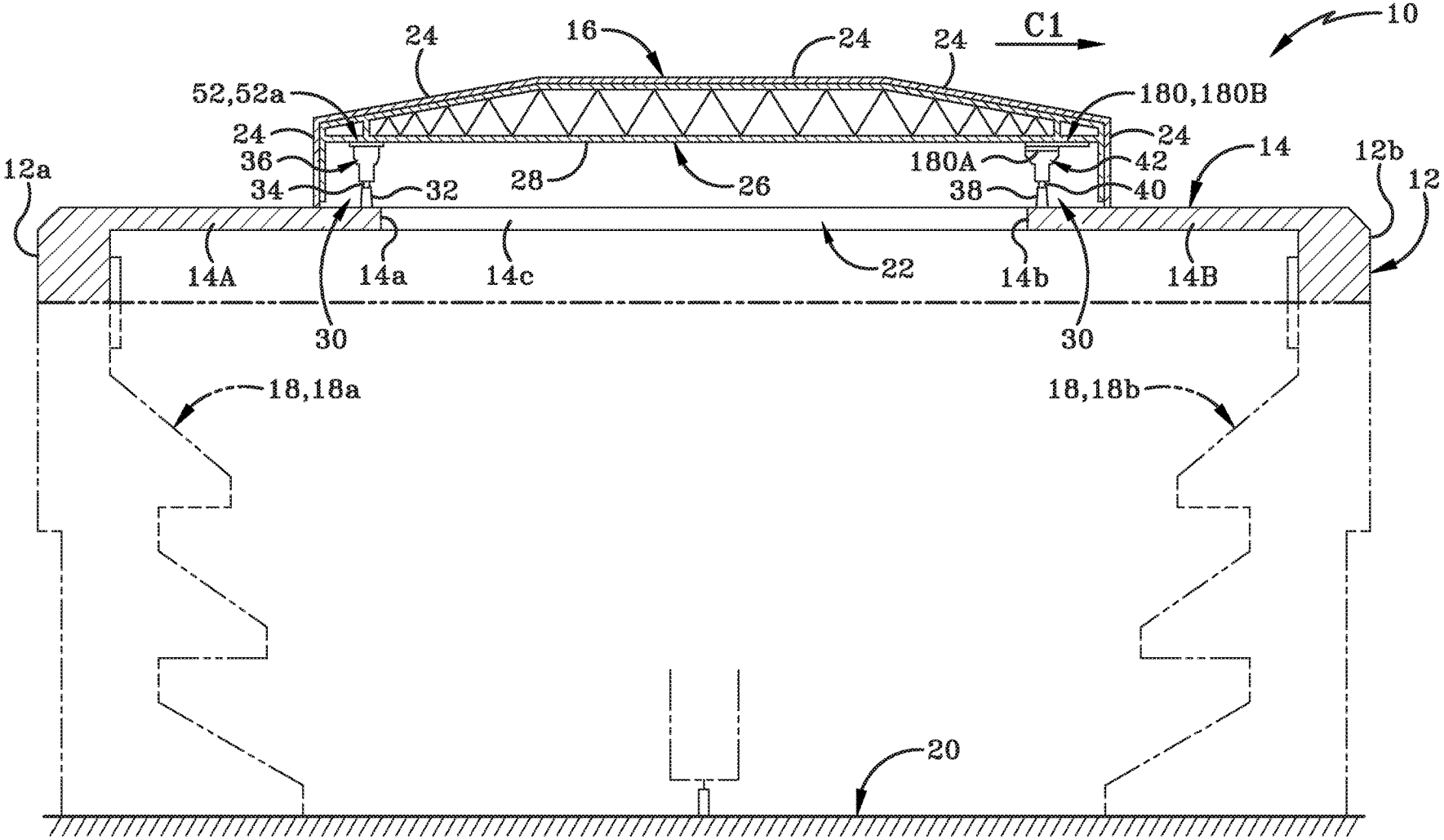
FIG. 14 is a diagrammatic top plan view of the athletic stadium showing one side region of the movable long-span structure expanding in a lateral first direction while the other side region of the movable long-span structure is fixed in place.

FIGS. 11A and 14 show second member 180B of bearing assembly 180 moved in a lateral first direction "C1". The movement of second member 180B is caused by movable roof structure 16 experiencing thermal expansion and is growing in length. The movement in the lateral first direction "C1" causes upper bearing plate 192 to slide relative to lower bearing plate 184 and thereby relative to support plate 182. Upper bearing plate 192 is integrally connected to slider plate 196. Slider plate 196 slides relative to lower bearing plates 184 and thereby relative to support plate 182. The sliding motion is facilitated by the low-friction interface of the first layer 188 of PTFE and the mirror polished second layer 198. Sliding motion causes edge 192*d* of upper bearing plate 192 to move a distance further outwardly beyond edge 182*e* of support plate 182 than when upper bearing plate 192 was in the neutral position. Additionally, the sliding motion causes edge 192*e* to move closer to edge 182*f* than when upper bearing plate 192 was in the neutral position. The bearing assembly 180 may be designed to allow second member 180B to move laterally through any desired distance. One suitable distance may be about two feet. In other words, upper bearing plate 192 may slide in the lateral first direction "C1" to the point that edge 192*d* is about two feet further away from edge 182*e* than was the case when upper bearing plate 192 was in the neutral position.

Second member 180B of bearing assembly 180 may move from the position shown in FIG. 11A in the lateral second direction "C2" (FIG. 15) because movable roof structure 16 is undergoing thermal contraction. The movement in the lateral second direction may simply cause the upper bearing plate 192 to slide back to the neutral position. In other instances, the decrease in length of the movable roof structure 16 because of thermal contraction may cause the upper bearing plate 192 to move out of the neutral position and in the lateral second direction "C2". The motion of upper bearing plate 192 moves edge 192*d* closer to edge 182*e* and moves edge 192*c* further outwardly from edge 182*f*. For example, upper bearing plate 192 may slide in the lateral second direction "C2" to the point that edge 192*c* is about two feet further away from edge 182*f* than was the case when upper bearing plate 192 was in the neutral position.

Second member 180B of bearing assembly 180 may slide relative to first member 180A through a relatively wide range of distances. The materials used to fabricate movable roof structure 16 will be designed to expand and contract within preset tolerances and these preset tolerances will tend to limit the extent of sliding motion between second member 180B and first member 180A as described above. In some examples stops (not shown) may be provided on bearing assembly 180 to prevent sliding motion beyond a certain point. It will be understood that the sliding distance of about two feet in the lateral first direction and two feet in the lateral second direction is given by way of example only. Bearing assembly 180 may be designed to permit sliding motion of less than two feet in each lateral direction or may be designed to permit sliding motion of more than two feet in each lateral direction. Furthermore, bearing assembly 180 may be designed to permit greater sliding motion in one lateral direction than in the other lateral direction.

Figure 15:
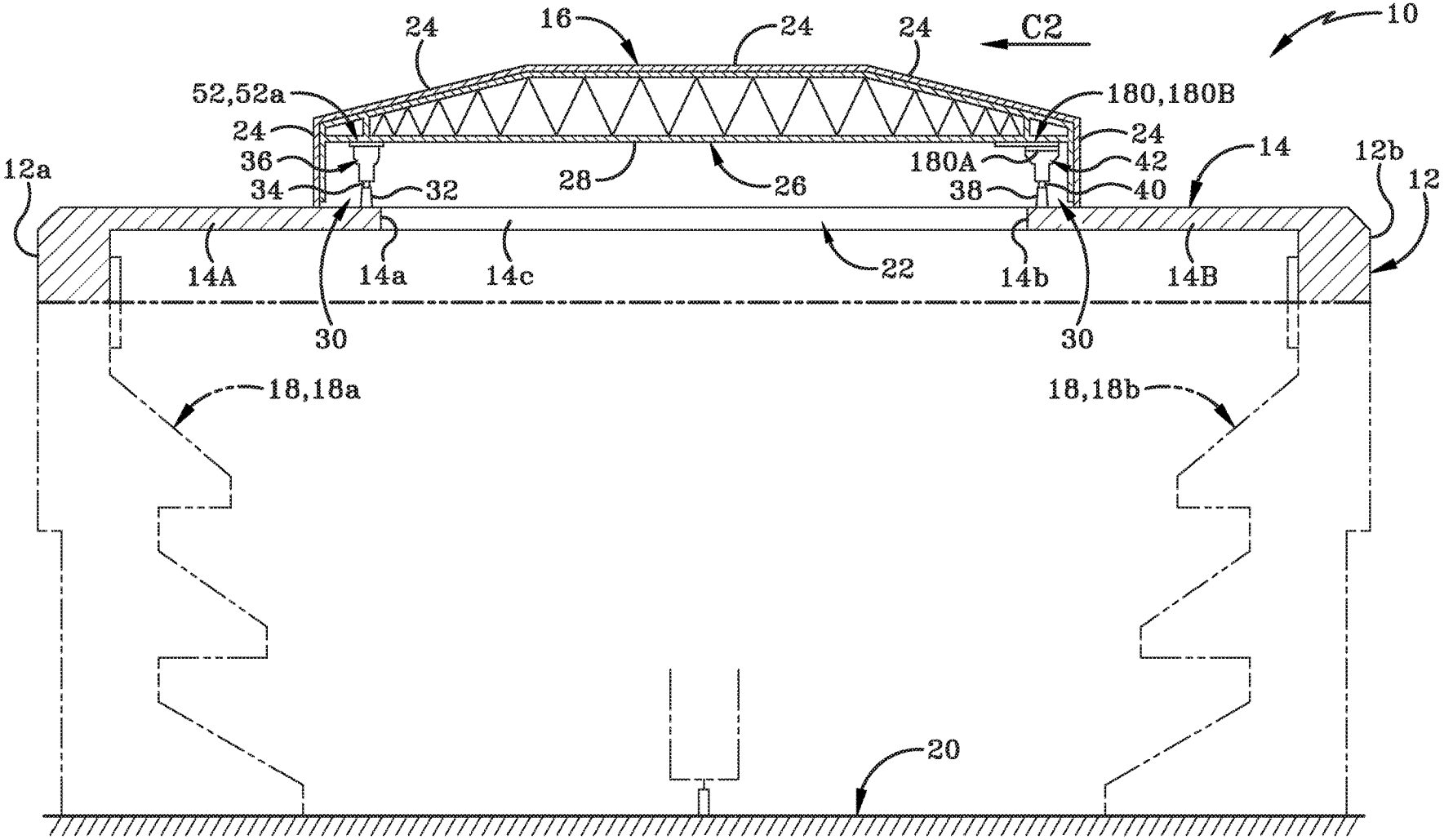
FIG. 15 is a diagrammatic top plan view of the athletic stadium showing one side region of the movable long-span structure contracting in a lateral second direction while the other side region of the movable long-span structure is fixed in place.

In summary, FIG. 2 shows movable roof structure 16 in a generally neutral position, i.e., where little to no thermal expansion or thermal contraction is being experienced by the movable roof structure 16. FIG. 14 shows movable roof structure 16 experiencing thermal expansion where the overall size of movable roof structure 16 is growing laterally in the direction indicated by arrow "C1". As a consequence, second member 180B of bearing assembly 180 has moved relative to first member 180A, and has moved closer towards second end 12*b* of stadium wall 12. FIG. 15 shows movable roof structure 16 experiencing thermal contraction where the overall size of movable roof structure 16 is shrinking laterally in the direction indicated by arrow "C2". As a consequence, second member 180B of bearing assembly 180 has moved relative to first member 180A, and has moved closer towards first end 12*a* of stadium wall 12. It should be noted that in any of the conditions illustrated in FIGS. 2, 14, and 15, movable roof structure 16 is able to be moved by first and second bogies 36, 42 along rails 34, 40 in either of the directions indicated by arrows "A" and "B" (FIGS. 12 and 13) to close off opening 22 or to expose opening 22.

Furthermore, since the plurality of first bogies 36 are fixedly engaged proximate a first side of movable roof structure 16 and the plurality of second bogies 42 are fixedly engaged proximate a second side of movable roof structure 16, because of the use of slide bearing assemblies 180, the direction of the "growth" of movable roof structure 16 through thermal expansion or thermal contraction is predictable. It is therefore possible for the probable load carried by the various first and second bogies 36, 42 to be readily calculated during the design phase of stadium 10. As a consequence, it is also possible to calculate the optimum number of first and second bogies 36, 42 that could be required in order to adequately and more safely support any particular movable long-span structure.

As was mentioned with respect to FIG. 8A, the height of second legs 194*b* of second guides 194 on bearing assembly 180 is smaller than the depth of channels 190*a* of first guides 190 within which second legs 194*b* are engaged. If a wind gust gets under movable roof structure 16, uplift of roof panel 24 may occur. (Uplift may also in some roof designs because of curvature of the trusses used to support the roof panels.) This uplift may result in damage to movable roof structure 16. However, the difference between the height of second legs 194*b* and the depth of channels 190*a* the second legs 194*b* are received in permits some restricted uplift motion between movable roof structure 16 and second bogies 42. The presence of second guides 194 helps to ensure that the roof panel 24 stays firmly engaged with the second bogies 42 and thereby with first and second girders 32, 38.

While first bogie 36 and second bogie 42 have been described herein as being configured to be engaged with a single rail 34, 40, respectively, it will be understood that one or both of first bogie 36 and second bogie 42 may, instead, be configured to be engaged with a track comprising a pair of spaced-apart parallel rails. In other examples, other mechanisms for moving first bogie 36 and second bogie 42 along a girder may be utilized instead of the wheel assemblies 48, 50 disclosed herein.

Furthermore, while at least some of the wheel assemblies disclosed herein have been disclosed as including motors and gear assemblies that are actuated to cause the first bogie 36 and second bogie 42 to move in one of a first longitudinal direction and a second longitudinal direction, it will be understood that any other mechanisms may be used instead of the motors and/or the gear assemblies to move the roof and bogies 36, 42. In some examples, the driving mechanism may be completely separate from bogies 36, 42 and then the bogies 36, 42 become idlers, in which case the three two-wheel trucks will not have any drive mechanism at all.

It will further be understood that each of the first bogie 36 and second bogie 42 may be provided with an electronic device that may be actuated by a remote computer. For example, first and second bogies 36, 42 may include a microprocessor that is operatively engaged with a centralized computer that may initiate and stop closing and opening of the movable long-span structure. In addition to controlling opening and closing of the roof structure, the remote computer may also be used to control speed, acceleration, position of one set of bogies 36, 42 relative to the other set of bogies 36, 42 to control skew, etc. The remote computer may also monitor all the electronic motor control drives (variable frequency drives), checks to make sure maximum speed thresholds have not been exceeded, opens and closes brakes, monitors the emergency stop pushbuttons, controls rail brakes and monitors travel limit switches as primary functions. The remote computer also monitors many non-primary functions and performs diagnostics.

The apparatus as disclosed herein is used in the following manner. A first rail 34 and a second rail 40 are mounted to a support structure in a stadium (e.g. wall 12 and/or fixed roof structure 14 or any other provided support) such that first rail 34 and second rail 40 are parallel to each other and spaced apart. A plurality of first bogies 36 is engaged on first rail 34. Each of the plurality of first bogies 34 is fixedly secured to a first region of a movable roof structure 16 (FIG. 2). A plurality of second bogies 42 is engaged on second rail 40; and a bearing assembly 180 on each of the plurality of second bogies 42 is secured to a second region of movable roof structure 16. The movable roof structure 16 may then undergo thermal expansion or thermal contraction (shrinkage), either of which may be described as "growth". When this "growth" occurs, the method involves sliding a slider plate 196 and thereby an upper bearing plate 192 of bearing assembly 180 laterally (i.e., at right angles to longitudinal axis "Y") with respect to second rail 40. Slider plate 196 and thereby upper bearing plate 192 may slide in a lateral first direction "C1" when the movable roof structure 16 thermally expands and may slide in a lateral second direction "C2" when the movable roof structure 16 contracts. The slider plate 196 and thereby the upper bearing plate 192 may slide through a distance in one of the lateral first direction "C1" and a lateral second direction "C2". Additionally, the slider plate 196 may slide relative to a second guides 194 and to the rest of second bogie 42, i.e., relative to primary and secondary equalizer beams 144, 46, and to wheel assemblies 48, 50.

At the same time as second bogie 42 is permitting movable roof structure 16 to grow laterally through the engagement of bearing assembly 180 with the second end (or second region) of movable roof structure 16, the fixed engagement of first bogies 36 with the first end (or first region) of movable roof structure 16 substantially prevents lateral movement of the first end or first region of the movable roof structure 16. The second bogie 42 disclosed herein, and the combination of the first bogies 36 and second bogies 42, in particular, enables forcing of growth of the movable roof structure 16 in a predetermined direction. This helps prevent excessive lateral loads from being applied to bogies 36, 42 by them trying to resist the growth of the roof 18. The lateral load in this instance due to growth is limited to friction at the bearing assembly 180.

It will be understood that in some examples, a small amount of lateral movement is permitted on the "fixed" side bogies to allow for rail misalignment and other factors. This small amount of lateral movement is enabled by allowing a small gap between the vertical faces of the pin connected parts (not using a slide bearing as is the case on the float side.

The apparatus disclosed herein may be used to support any number of support points on a truss. For example, it is contemplated that the system may include three rails with a center rail being fixed and the outer rails being allowed to float.

It will further be understood that the disclosed apparatus, systems, and methods may be applied to almost any long-span structure, particularly a long-span structure that moves on a rail system with bogies or on any other type of transport system. This disclosure should not be construed as being limited only to movable long-spans on athletic stadiums in the form of movable roof structures.

It will be understood that in some embodiments, the disclosed apparatus, which comprises an expansion bearing assembly sitting atop a bogie, can include any even number of wheels. In practical terms, the expansion bearing assembly may be provided on any transport device that has from two to sixteen or more wheels. In one embodiment, for example, the expansion bearing assembly may be mounted on top of a simple two-wheeled truck. In this configuration, equalizer beams would not be necessary. The purpose of the equalizer beams is to make the wheel loads determinate and the apparatus will include the minimum number of equalizer beams that make it possible to make the wheel loads determinate. The equalizer beams are generally designed to fit into the available space. There may be many ways to configure the equalizer beams accordingly. For example, if headroom is not an issue, the equalizer beams may be straight and without sloped sections. It should be understood that the disclosed apparatus may be free of equalizer beams or may include any number required to make the wheel loads determinate. The shape of the equalizer beams may also be varied based on the configuration of the stadium into which the roof is to be installed. It will be understood that the specific number and shape of equalizer beams disclosed herein is by way of example only and should not be construed as limiting the invention to the specific configuration disclosed herein.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A movable long-span structure comprising:

at least one long-span assembly having a first region spaced laterally from a second region;

a plurality of first transport devices fixedly engaged with the first region;

a plurality of second transport devices operatively engaged with the second region, wherein the plurality of first transport devices and the plurality of second transport devices are actuated to selectively move the at least one long-span assembly in one of a first longitudinal direction and a second longitudinal direction; and a plurality of slide bearing assemblies, wherein each of the plurality of slide bearing assemblies includes a linear slide bearing which secures one of the plurality of second transport devices to the second region of the at least one long-span assembly and enables selective movement of the second region of the at least one long-span assembly relative to the first region thereof in one of a first lateral direction and a second lateral direction; and wherein each linear slide bearing includes:

a lower bearing plate fixedly engaged with the one of the plurality of second transport devices; and an upper bearing plate fixedly engaged with the second region of the at least one long-span assembly; wherein the upper bearing plate is configured to slide laterally relative to the lower bearing plate; and wherein each of the lower bearing plate and the upper bearing plate is flat.

2. The movable long-span structure according to claim 1, wherein each of the plurality of first transport devices is a first bogie and each of the plurality of second transport devices is a second bogie, and wherein the movable long-span structure further comprises:

a first rail and a second rail oriented parallel to each other, wherein each the plurality of first bogies is engaged with the first rail and each of the plurality of second bogies is engaged with the second rail; and wherein the plurality of first bogies and the plurality of second bogies are actuatable to move the at least one long-span assembly in the one of the first longitudinal direction and the second longitudinal direction.

3. The movable long-span structure according to claim 1, wherein each of the plurality of second transport devices comprises:

a body having a top, a bottom, a first end, a second end, and a first side and a second side extending between the first end and the second end; wherein the body has a longitudinal axis extending between the first end and the second end; and one or more wheel assemblies provided on the body, said one or more wheel assemblies being actuatable to move the body in the one of the first longitudinal direction and the second longitudinal direction along a pathway.

4. The movable long-span structure according to claim 1, wherein a movement axis of one or both of the lower bearing plate and the upper bearing plate is oriented at right angles to the longitudinal axis of the body.

5. The movable long-span structure according to claim 1, further comprising one of a low-friction material and a friction-reducing surface applied to an upper surface of the lower bearing plate and the other of the low-friction material and the friction-reducing surface applied to a lower surface of the upper bearing plate.

6. A system for moving a long-span structure relative to a base member; said system comprising:

at least one first bogie engaged proximate a first end of a long-span structure and movable along a first track; and at least one second bogie engaged proximate a second end of the long-span structure and movable along a second track;

wherein the first end and the second end of the long-span structure are spaced laterally apart from each other;

wherein the first track and second track extend longitudinally;

wherein the at least one first bogie and the at least one second bogie are actuatable to move in unison along the first track and the second track in one of a first longitudinal direction and a second longitudinal direction and thereby move the long-span structure relative to the base member in the one of the first longitudinal direction and the second longitudinal direction;

wherein each of the at least one second bogie includes a linear slide bearing assembly interposed between a body of the at least one second bogie and the long-span structure; and wherein the bearing assembly includes:

a lower bearing plate engaged with the body of the at least one second bogie; and an upper bearing plate engaged with the long-span structure;

wherein each of the lower bearing plate and the upper bearing plate is flat; and wherein the upper bearing plate slides laterally relative to the lower bearing plate as the long-span structure undergoes one of thermal expansion and thermal contraction.

7. A bogie for supporting a long-span structure, said bogie comprising:

a body having a top, a bottom, a first end, a second end, and a first side and a second side extending between the first end and the second end;

wherein the body has a longitudinal axis extending between the first end and the second end;

a drive system provided on the body, said drive system being actuatable to move the body in one of a first longitudinal direction and a second longitudinal direction along a pathway; and a bearing assembly provided on the body; said bearing assembly being adapted to be engaged with the long-span structure; and wherein each bearing assembly is a linear slide bearing assembly which comprises:

a lower bearing plate fixedly engaged with the body; and an upper bearing plate fixedly engaged with the long-span structure; wherein the upper bearing plate is configured to slide relative to the lower bearing plate; and wherein each of the lower bearing plate and the upper bearing plate is flat.

8. The bogie according to claim 7, wherein one or both of the lower bearing plate and the upper bearing plate is oriented at right angles to the longitudinal axis of the body and the upper bearing plate slides substantially parallel to a lateral axis of the body, wherein the lateral axis is oriented at right angles to the longitudinal axis of the body.

9. A method of moving a long-span structure comprising:

mounting a first rail and a second rail to a support structure such that the first rail and second rail are parallel to one another, are laterally spaced apart, and are longitudinally oriented;

engaging a plurality of first transport devices on the first rail;

fixedly securing each of the plurality of first transport devices to a first region of the movable long-span structure;

engaging a plurality of second transport devices on the second rail;

securing a flat lower bearing plate of a linear slide bearing to each one of the plurality of second transport devices;

securing a flat upper bearing plate of the linear slide bearing to the second region of the movable long-span structure;

actuating the plurality of first transport devices and the plurality of second transport devices;

longitudinally moving the movable long-span structure along the first rail and the second rail with the plurality of first transport devices and the plurality of second transport devices from a first position to a second position remote from the first position; and laterally sliding the flat upper bearing plate of each linear slide bearing relative to the flat lower bearing plate thereof as the movable long-span structure thermally expands or thermally contracts.

10. The method according to claim 9, wherein the laterally sliding includes:

sliding the flat upper bearing plate in a lateral first direction relative to the flat lower bearing plate when the movable long-span structure thermally expands and sliding the flat upper bearing plate in a lateral second direction relative to the flat lower bearing plate when the movable long-span structure thermally contracts.

11. The method according to claim 9, further comprising:

substantially preventing lateral movement of the first region of the movable long-span structure with the plurality of first transport devices.

12. The method according to claim 11, further comprising:

permitting lateral movement of the second region of the movable long-span structure with the linear slide bearing of each of the plurality of second transport devices.

* * * * *